US008511500B2

(12) United States Patent
Teys et al.

(10) Patent No.: US 8,511,500 B2
(45) Date of Patent: Aug. 20, 2013

(54) DISPENSING CONTAINER

(75) Inventors: Bradley Donald Teys, Shelly Beach (AU); David Michael Prickett, Albany Creek (AU); Neil Stewart Waldbaum, Currimundi (AU)

(73) Assignee: Sands Innovations Pty. Ltd., Brisbane (AU)

( * ) Notice: Subject to any disclaimer, the term of this patent is extended or adjusted under 35 U.S.C. 154(b) by 269 days.

(21) Appl. No.: 12/795,220

(22) Filed: Jun. 7, 2010

(65) Prior Publication Data

US 2011/0297690 A1 Dec. 8, 2011

(51) Int. Cl.
*B65D 41/32* (2006.01)
*B65D 8/18* (2006.01)

(52) U.S. Cl.
USPC ..... 220/265; 220/266; 220/4.23

(58) Field of Classification Search
USPC ..... 220/254.6, 258.3, 258.5, 265, 266, 220/268, 270, 269, 359.1, 367.1, 556, 712, 220/787, 789, 833, 834, 835
See application file for complete search history.

(56) References Cited

U.S. PATENT DOCUMENTS

| | | | |
|---|---|---|---|
| 1,000,178 | A | 8/1911 | Kahl |
| 1,372,325 | A | 3/1921 | Willemin |
| 1,754,973 | A | 4/1930 | Walch |
| 2,654,252 | A | 10/1953 | Davis |
| 2,837,822 | A | 6/1958 | Wille |
| 3,036,700 | A | 5/1962 | Krug |
| 3,075,639 | A | 1/1963 | Lingley |
| 3,116,152 | A | 12/1963 | Smith |
| 3,133,679 | A | 5/1964 | Brown |
| 3,154,418 | A | 10/1964 | Lovell |
| D209,953 | S | 1/1968 | Stehl |
| 3,410,457 | A | 11/1968 | Brown |
| 3,421,654 | A | 1/1969 | Hexel |
| 3,428,460 | A | 2/1969 | Ely |
| D216,306 | S | 12/1969 | Dutch |
| 3,521,805 | A | 7/1970 | Ward |
| 3,581,885 | A | 6/1971 | Wald |
| 3,618,751 | A | 11/1971 | Rich |
| 3,620,676 | A | 11/1971 | Davis |
| 3,635,376 | A | 1/1972 | Hellstrom |

(Continued)

FOREIGN PATENT DOCUMENTS

| | | |
|---|---|---|
| AU | 63787/98 | 11/1998 |
| AU | 1999 47456 | 2/2000 |

(Continued)

OTHER PUBLICATIONS

International Search Report and Written Opinion dated Feb. 21, 2012 from corresponding International (PCT) Application No. PCT/IB2011/001207, 9 pages.

(Continued)

*Primary Examiner* — J. Gregory Pickett
*Assistant Examiner* — Kaushikkumar Desai
(74) *Attorney, Agent, or Firm* — Fitch, Even, Tabin & Flannery

(57) ABSTRACT

There is disclosed a container for receiving and sealing material in an internal cavity. The container is configured to be shiftable about an intermediate hinge portion and provides a dispensation port defined by a frangible connected panel of the container. The panel can be reclosed after initial severing of the frangible connection upon initial opening.

33 Claims, 16 Drawing Sheets

(56) References Cited

U.S. PATENT DOCUMENTS 3,648,369 A 3/1972 Frodsham
3,741,384 A 6/1973 Cloud
3,756,386 A 9/1973 Marckardt
3,776,375 A 12/1973 Rohdin
3,835,995 A 9/1974 Haines
3,872,970 A 3/1975 Edison
3,891,331 A 6/1975 Avery
3,911,578 A 10/1975 Ushkow et al.
3,913,734 A 10/1975 Siegel
3,921,805 A 11/1975 Compere
3,946,652 A 3/1976 Gorin
3,948,394 A 4/1976 Hellstrom
3,986,640 A 10/1976 Redmond
4,005,776 A 2/1977 Seeley
4,011,949 A 3/1977 Braber et al.
4,106,621 A 8/1978 Sorenson
4,155,454 A 5/1979 Ryden
4,218,155 A 8/1980 Weidner
4,231,496 A 11/1980 Gilson
4,236,652 A 12/1980 Beguhn
4,266,667 A 5/1981 Ishigaki
D259,533 S 6/1981 Frodsham
4,275,646 A 6/1981 Barna
4,277,194 A 7/1981 Smith
D263,074 S 2/1982 Mason
4,317,284 A 3/1982 Prindle
4,331,255 A * 5/1982 Fournier ..... 220/257.2
4,338,338 A 7/1982 Popkes
4,341,302 A 7/1982 Baker et al.
4,387,809 A 6/1983 Botzler
D275,517 S 9/1984 Hamilton et al.
4,493,574 A 1/1985 Redmond et al.
4,499,353 A 2/1985 Shields et al.
D281,719 S 12/1985 Holewinski et al.
D281,813 S 12/1985 Holewinski et al.
4,580,587 A 4/1986 Rittich et al.
4,602,719 A 7/1986 Borst
4,611,715 A 9/1986 Redmond
4,615,120 A 10/1986 Newman
4,655,627 A 4/1987 Bradley
4,687,129 A 8/1987 Cugley
4,724,982 A 2/1988 Redmond
4,784,268 A 11/1988 Perchak
4,790,429 A 12/1988 Fukushima
4,830,222 A 5/1989 Read
4,841,637 A 6/1989 Scholzen
4,871,091 A 10/1989 Preziosi
4,888,188 A 12/1989 Castner, Sr. et al.
4,891,232 A 1/1990 Dahl
4,921,137 A 5/1990 Heijenga
4,922,611 A 5/1990 Levy
4,938,462 A 7/1990 Gould
5,009,894 A 4/1991 Hsiao
5,027,947 A 7/1991 Reighart
5,048,715 A 9/1991 Wolff
5,067,822 A 11/1991 Wirth et al.
5,105,603 A 4/1992 Natterer
D327,013 S 6/1992 Reighart
5,119,560 A 6/1992 Noble
5,125,528 A * 6/1992 Heyn et al. ..... 220/269
5,125,534 A 6/1992 Rose et al.
RE34,087 E 10/1992 Redmond
D330,481 S 10/1992 Green
5,154,293 A 10/1992 Gould
5,154,318 A 10/1992 Lampard
5,158,192 A 10/1992 Lataix
D334,058 S 3/1993 Noble
5,203,459 A 4/1993 Wade
5,209,354 A 5/1993 Thornhill et al.
5,215,221 A 6/1993 Dirksing
5,238,157 A 8/1993 Gentile
5,238,179 A 8/1993 Hart
5,240,415 A 8/1993 Haynie
D340,408 S 10/1993 Hirsch
5,251,758 A 10/1993 Kolacek
5,277,103 A 1/1994 Cox
D344,058 S 2/1994 Jones
5,305,928 A 4/1994 Verdaguer
D347,277 S 5/1994 Snedden
5,308,008 A 5/1994 Ruegg
5,348,191 A 9/1994 Dekeyser
5,377,879 A 1/1995 Isaacs
5,392,945 A 2/1995 Syrek
5,395,031 A 3/1995 Redmond
5,398,908 A 3/1995 Kienle
5,408,804 A 4/1995 Schroder
5,409,125 A 4/1995 Kimber et al.
D358,466 S 5/1995 Harris et al.
5,411,178 A 5/1995 Roders et al.
5,426,919 A 6/1995 Natterer et al.
5,431,357 A 7/1995 Ruegg
5,437,881 A 8/1995 Jeannin
5,440,976 A 8/1995 Giuliano et al.
D362,304 S 9/1995 Wilson et al.
5,464,595 A 11/1995 Finnah
5,477,660 A 12/1995 Smith
5,491,895 A 2/1996 Lee
5,494,192 A 2/1996 Redmond
5,494,252 A 2/1996 Amit et al.
5,529,224 A 6/1996 Chan et al.
D371,491 S 7/1996 Stein
5,553,805 A 9/1996 Ruegg
D375,055 S 10/1996 Reed
5,564,569 A 10/1996 Kiefer
D375,352 S 11/1996 Bologna
D375,353 S 11/1996 Wolff
5,577,627 A 11/1996 Richie-Dubler
5,579,957 A 12/1996 Gentile et al.
5,582,330 A 12/1996 Iba
RE35,437 E 2/1997 Ascone
5,676,244 A 10/1997 Green et al.
5,676,280 A 10/1997 Robinson
5,676,990 A 10/1997 Wawrzynski
5,695,084 A 12/1997 Chmela et al.
5,705,212 A 1/1998 Atkinson
5,706,980 A 1/1998 Dickerson
5,792,496 A 8/1998 Fekete et al.
D398,843 S 9/1998 Wiegner
5,826,737 A 10/1998 Zakensberg
5,827,535 A 10/1998 Stone
5,839,609 A 11/1998 Zakensberg
D402,546 S 12/1998 Massing
D403,512 S 1/1999 Hennings
5,873,167 A 2/1999 Mason
5,873,483 A 2/1999 Gortz et al.
5,875,914 A 3/1999 Nguyen et al.
D407,640 S 4/1999 Nelson et al.
D408,217 S 4/1999 LoGiudice
D408,278 S 4/1999 Konop
5,944,516 A 8/1999 Deshaies
5,975,305 A 11/1999 Barger
5,979,657 A 11/1999 Bumbera
6,003,673 A 12/1999 Vieu
6,003,710 A 12/1999 Huang
6,006,505 A 12/1999 Natterer
6,007,246 A 12/1999 Kinigakis et al.
D419,063 S 1/2000 Baker et al.
6,024,219 A 2/2000 Froehlich et al.
6,041,930 A 3/2000 Cockburn
D422,851 S 4/2000 Joergensen
D425,617 S 5/2000 Snedden
6,062,413 A 5/2000 Redmond
D426,708 S 6/2000 Francis
6,070,723 A 6/2000 Lewis
6,085,497 A 7/2000 Natterer
6,085,942 A 7/2000 Redmond
6,105,259 A 8/2000 Meyers et al.
6,112,898 A 9/2000 Siragusa et al.
6,116,450 A 9/2000 Huang
6,153,232 A 11/2000 Holten et al.
D435,665 S 12/2000 Ogle
6,159,513 A 12/2000 Judlowe et al.
D438,125 S 2/2001 Kaposi et al.
D440,810 S 4/2001 Olson 6,209,748 B1 4/2001 Dunbar
6,213,662 B1 4/2001 Aljanedi
6,241,124 B1 6/2001 Hoyt
6,245,367 B1 6/2001 Galomb
6,254,907 B1 7/2001 Galomb
6,279,233 B1 8/2001 Cameron
D447,560 S 9/2001 Hellberg et al.
6,282,866 B1 9/2001 Natterer et al.
6,286,731 B1 9/2001 Lillelund et al.
6,287,612 B1 9/2001 Mandava et al.
6,295,735 B1 10/2001 Barger
6,299,012 B1 10/2001 Redmond
6,311,837 B1 11/2001 Blaustein et al.
6,328,928 B1 12/2001 Schroeder et al.
6,336,310 B1 1/2002 Redmond
6,341,472 B1 1/2002 Schroeder
6,347,727 B1 2/2002 Diaz
6,348,246 B1 2/2002 Finestone et al.
6,349,866 B1 2/2002 Stewart et al.
6,357,626 B1 3/2002 Zhang et al.
D456,507 S 4/2002 LeMarr et al.
6,364,113 B1 4/2002 Faasse, Jr. et al.
6,364,203 B2 4/2002 Toussant et al.
6,364,519 B1 4/2002 Hughes et al.
6,372,176 B1 4/2002 Ekendahl et al.
6,386,443 B1 5/2002 Szczerbinski
6,390,358 B1 5/2002 Stewart et al.
6,395,317 B1 5/2002 Singh et al.
D458,809 S 6/2002 Richardson et al.
6,412,653 B1 7/2002 Waterhouse
6,415,939 B1 7/2002 Redmond
D463,275 S 9/2002 Garcia
6,457,612 B1 10/2002 Zhang et al.
6,460,781 B1 10/2002 Garcia et al.
6,471,122 B1 10/2002 Stewart et al.
6,472,007 B2 10/2002 Bezek et al.
D467,336 S 12/2002 Gilbard et al.
D467,499 S 12/2002 Garza et al.
6,516,939 B1 2/2003 Schmidt et al.
D471,628 S 3/2003 Louviere
6,536,974 B2 3/2003 Redmond
6,550,224 B2 4/2003 Kleinschmidt
6,558,150 B1 5/2003 Karbach
6,589,041 B2 7/2003 Feil
6,589,042 B2 7/2003 Stammler et al.
6,596,328 B1 7/2003 Bezek et al.
D477,965 S 8/2003 Kortleven et al.
D479,674 S 9/2003 Freed
D480,318 S 10/2003 Settele
D482,578 S 11/2003 Kortleven et al.
6,649,114 B2 11/2003 Lochner et al.
6,651,848 B1 11/2003 Redmond
D482,939 S 12/2003 Lillelund et al.
D483,257 S 12/2003 Lim
D484,425 S 12/2003 Settele
6,655,903 B2 12/2003 Kohler
6,662,454 B2 12/2003 Harrold
6,663,019 B2 12/2003 Garcia et al.
6,673,301 B2 1/2004 Cargile et al.
6,675,482 B1 1/2004 Gilbert, Jr. et al.
6,685,058 B2 2/2004 Redmond
6,688,469 B1 2/2004 Barnes
6,691,901 B2 2/2004 Parve et al.
6,692,212 B2 2/2004 Trautwein et al.
D487,397 S 3/2004 Peghini
6,698,165 B1 3/2004 Natterer
6,699,006 B2 3/2004 Schlimgen et al.
6,701,692 B1 3/2004 Niehr
6,706,297 B1 3/2004 Toth et al.
6,712,599 B2 3/2004 Schlimgen et al.
D488,079 S 4/2004 Mastroianni
D488,394 S 4/2004 Overthun et al.
6,726,054 B2 4/2004 Fagen et al.
D489,820 S 5/2004 Masuda et al.
6,736,379 B1 5/2004 Wegner et al.
D492,407 S 6/2004 Masuda et al.
D494,676 S 8/2004 Dubniczki et al.
D494,877 S 8/2004 Kempe et al.
6,769,558 B1 8/2004 Bucholtz
6,769,684 B2 8/2004 Gandelheidt
6,783,030 B2 8/2004 Redmond
6,802,423 B2 10/2004 O'Brien
D500,850 S 1/2005 Clark et al.
6,845,597 B2 1/2005 Redmond
6,848,339 B2 2/2005 Hakim
6,851,920 B2 2/2005 Trautwein et al.
6,860,405 B1 3/2005 Poynter
6,874,665 B2 4/2005 Doherty et al.
6,905,323 B2 6/2005 Keller
6,910,623 B2 6/2005 Stewart et al.
6,928,870 B1 8/2005 Lieborwitz
6,942,097 B1 9/2005 Stremple et al.
6,953,420 B2 10/2005 Karbach
6,957,909 B1 10/2005 Dingeldein et al.
D511,645 S 11/2005 Fort et al.
D514,935 S 2/2006 Sturk
7,004,322 B1 2/2006 Bartoli
7,005,109 B2 2/2006 Husar
D517,207 S 3/2006 Poynter
7,013,568 B2 3/2006 Schmidt
D524,610 S 7/2006 Kushner
7,069,705 B2 7/2006 Redmond
7,104,419 B2 9/2006 Fagen et al.
7,121,409 B1 10/2006 Hamilton et al.
D531,918 S 11/2006 Heiligenstein et al.
7,140,863 B2 11/2006 Koppenhofer
7,143,910 B2 12/2006 Redmond
D534,610 S 1/2007 Kushner
D534,648 S 1/2007 Zahn et al.
7,175,215 B2 2/2007 Harris
D539,420 S 3/2007 Zahn et al.
7,198,161 B2 4/2007 Bucholtz
7,210,600 B1 5/2007 Delio, Jr.
7,219,816 B1 5/2007 Xia et al.
7,226,230 B2 6/2007 Liberatore
D545,636 S 7/2007 Risden
D545,640 S 7/2007 Risden
D547,134 S 7/2007 Everett et al.
D547,860 S 7/2007 Zahn et al.
7,240,797 B1 7/2007 Grossman
D548,834 S 8/2007 Hansen
7,258,255 B2 8/2007 Vogel et al.
D551,760 S 9/2007 Zahn et al.
7,270,239 B1 9/2007 Ross
D556,321 S 11/2007 Starnes
7,290,380 B2 11/2007 Natterer
7,293,683 B2 11/2007 Natterer
7,299,947 B2 11/2007 Lingenhoff
D560,442 S 1/2008 Teys et al.
D560,443 S 1/2008 Teys et al.
7,314,196 B2 1/2008 Gandelheidt et al.
7,314,328 B2 1/2008 Liberatore
7,320,398 B2 1/2008 Bertl et al.
7,325,370 B2 2/2008 Redmond
7,325,703 B2 2/2008 Gherdan et al.
7,325,994 B2 2/2008 Liberatore
D565,193 S 3/2008 Price
7,347,680 B2 3/2008 Hessenbruch
D567,004 S 4/2008 Bottega
7,361,008 B2 4/2008 Crepaz
7,370,564 B2 5/2008 Hennes
7,374,046 B1 5/2008 O'Brien
D570,164 S 6/2008 Teys et al.
D571,002 S 6/2008 Starnes
D572,089 S 7/2008 Teys et al.
D572,976 S 7/2008 Mansfield
7,413,080 B2 8/2008 Van House
7,413,083 B2 8/2008 Belfance et al.
7,431,529 B1 10/2008 Rushe et al.
D580,715 S 11/2008 Finell
7,478,960 B2 1/2009 Glover
7,487,625 B2 2/2009 Natterer et al.
7,487,894 B2 2/2009 Zahn et al.
7,490,974 B2 2/2009 Hennes
7,503,604 B2 3/2009 Raeder et al.
7,506,762 B2 3/2009 Nelson et al.
7,513,397 B2 4/2009 Zahn et al.
D592,826 S 5/2009 Lingenhoff

| | | | | |
|---|---|---|---|---|
| 7,540,291 | B2 | 6/2009 | Gandelheidt | |
| 7,556,147 | B2 | 7/2009 | Leiner et al. | |
| 7,562,796 | B2 | 7/2009 | Zahn et al. | |
| 7,568,590 | B1 | 8/2009 | Gross et al. | |
| 7,571,813 | B2 | 8/2009 | Weisskopf | |
| 7,600,358 | B2 | 10/2009 | Natterer | |
| D604,635 | S | 11/2009 | Xu | |
| 7,628,125 | B2 | 12/2009 | Kaita et al. | |
| 7,631,776 | B2 | 12/2009 | Vovan et al. | |
| 7,648,328 | B2 | 1/2010 | Binder et al. | |
| D609,362 | S | 2/2010 | Rannikko et al. | |
| 7,669,597 | B2 | 3/2010 | Sullivan et al. | |
| 7,669,714 | B1 | 3/2010 | Grossman | |
| 7,690,883 | B2 | 4/2010 | Huber et al. | |
| 7,703,619 | B2 | 4/2010 | Van Puijenbroek | |
| D636,890 | S | 4/2011 | Teys et al. | |
| 7,922,021 | B2 | 4/2011 | Golden | |
| 7,993,692 | B2 | 8/2011 | Finley et al. | |
| 8,028,837 | B2 | 10/2011 | Gerstle et al. | |
| 8,091,242 | B2 | 1/2012 | Teys et al. | |
| 8,151,984 | B2 | 4/2012 | Braeder et al. | |
| 8,403,936 | B2 | 3/2013 | Hess et al. | |
| 2001/0001470 | A1 | 5/2001 | Toussant et al. | |
| 2002/0104856 | A1 | 8/2002 | Clark et al. | |
| 2002/0113074 | A1 | 8/2002 | Baker et al. | |
| 2002/0180114 | A1 | 12/2002 | Cargile et al. | |
| 2003/0015605 | A1 | 1/2003 | Garcia et al. | |
| 2003/0029868 | A1 | 2/2003 | Davidov et al. | |
| 2003/0066870 | A1 | 4/2003 | Stewart | |
| 2003/0183641 | A1 | 10/2003 | Asbury | |
| 2003/0222099 | A1 | 12/2003 | Keller | |
| 2004/0006874 | A1 | 1/2004 | Kamm et al. | |
| 2004/0074802 | A1 | 4/2004 | Piliero et al. | |
| 2004/0094548 | A1 | 5/2004 | Laveault | |
| 2004/0105715 | A1 | 6/2004 | Spelman et al. | |
| 2004/0187662 | A1 | 9/2004 | Ulmer | |
| 2005/0042019 | A1 | 2/2005 | Gaynes et al. | |
| 2005/0116482 | A1 | 6/2005 | Harris | |
| 2005/0218106 | A1 | 10/2005 | Yui | |
| 2005/0236442 | A1 | 10/2005 | Kratzer | |
| 2005/0249031 | A1 | 11/2005 | Morgese et al. | |
| 2005/0252351 | A1 | 11/2005 | Natterer | |
| 2006/0124654 | A1* | 6/2006 | Cai | 220/780 |
| 2006/0191805 | A1 | 8/2006 | Vogel et al. | |
| 2006/0283727 | A1 | 12/2006 | Nelson et al. | |
| 2007/0012710 | A1* | 1/2007 | Vovan | 220/793 |
| 2007/0045317 | A1 | 3/2007 | Rosender et al. | |
| 2007/0084064 | A1 | 4/2007 | Fite et al. | |
| 2007/0102308 | A1 | 5/2007 | Tremblay et al. | |
| 2007/0125667 | A1 | 6/2007 | Lee et al. | |
| 2007/0187277 | A1 | 8/2007 | Furlong | |
| 2007/0235104 | A1 | 10/2007 | Lingenhoff | |
| 2007/0267183 | A1 | 11/2007 | Hennes | |
| 2008/0002921 | A1 | 1/2008 | Redmond | |
| 2008/0034710 | A1 | 2/2008 | Ehrmann | |
| 2008/0040862 | A1 | 2/2008 | Bravo | |
| 2008/0072432 | A1 | 3/2008 | Teys et al. | |
| 2008/0072433 | A1 | 3/2008 | Ohring et al. | |
| 2008/0149523 | A1 | 6/2008 | O'Brien | |
| 2008/0152767 | A1 | 6/2008 | Maisel | |
| 2008/0191381 | A1 | 8/2008 | Hennes | |
| 2008/0210716 | A1 | 9/2008 | Weyts | |
| 2008/0278340 | A1 | 11/2008 | Jokele et al. | |
| 2009/0000255 | A1 | 1/2009 | Dandl et al. | |
| 2009/0025340 | A1 | 1/2009 | Natterer et al. | |
| 2009/0050649 | A1 | 2/2009 | Rushe et al. | |
| 2009/0057386 | A1 | 3/2009 | Redmond | |
| 2009/0071099 | A1 | 3/2009 | Ehrmann et al. | |
| 2009/0071100 | A1 | 3/2009 | Ehrmann et al. | |
| 2009/0071107 | A1 | 3/2009 | Ehrmann | |
| 2009/0097949 | A1 | 4/2009 | Binder et al. | |
| 2009/0152261 | A1 | 6/2009 | Capriotti | |
| 2009/0173039 | A1 | 7/2009 | Slomski et al. | |
| 2009/0173041 | A1 | 7/2009 | Moessnang | |
| 2009/0173049 | A1 | 7/2009 | Ruzic et al. | |
| 2009/0217532 | A1 | 9/2009 | Cantu | |
| 2009/0217625 | A1 | 9/2009 | Moessnang | |
| 2009/0218374 | A1 | 9/2009 | Liberatore | |
| 2009/0241469 | A1 | 10/2009 | Moessnang et al. | |
| 2009/0255218 | A1 | 10/2009 | Moessnang | |
| 2009/0260319 | A1 | 10/2009 | Botzenhardt et al. | |
| 2009/0260320 | A1 | 10/2009 | Miller et al. | |
| 2009/0260325 | A1 | 10/2009 | Haering | |
| 2009/0260326 | A1 | 10/2009 | Grimm et al. | |
| 2009/0261230 | A1 | 10/2009 | Imhof | |
| 2009/0266028 | A1 | 10/2009 | Zeller et al. | |
| 2009/0288365 | A1 | 11/2009 | Negele | |
| 2009/0294454 | A1 | 12/2009 | Harding | |
| 2009/0314415 | A1 | 12/2009 | Gross et al. | |
| 2009/0314777 | A1 | 12/2009 | Gross et al. | |
| 2010/0024360 | A1 | 2/2010 | Ehrmann et al. | |
| 2010/0024668 | A1 | 2/2010 | Huber et al. | |
| 2010/0065567 | A1 | 3/2010 | Vovan | |
| 2010/0065582 | A1 | 3/2010 | Nelson et al. | |
| 2010/0095640 | A1 | 4/2010 | Grimm | |
| 2010/0107572 | A1 | 5/2010 | Slomp et al. | |
| 2010/0108680 | A1 | 5/2010 | Vovan et al. | |
| 2010/0116772 | A1 | 5/2010 | Teys | |
| 2011/0024462 | A1 | 2/2011 | Teys | |
| 2011/0100859 | A1 | 5/2011 | Burattini | |
| 2011/0290800 | A1 | 12/2011 | Teys | |

FOREIGN PATENT DOCUMENTS

| | | | |
|---|---|---|---|
| AU | 750188 | | 5/2001 |
| AU | 764881 | | 9/2003 |
| AU | 2004 100000 | | 2/2004 |
| AU | 2004100000 | | 2/2004 |
| AU | 200415919 | | 6/2005 |
| AU | 200415920 | | 6/2005 |
| BE | 1008054 | | 1/1996 |
| CA | 2376147 | | 4/2001 |
| CN | 2081671 | U | 7/1991 |
| DE | 2124931 | | 11/1972 |
| DE | 2232861 | | 1/1974 |
| DE | 7523870 | | 11/1976 |
| DE | 19627243 | | 1/1998 |
| DE | 19904649 | | 10/2000 |
| DE | 7237741 | | 10/2002 |
| DE | 202004006760 | | 9/2005 |
| DE | 102004055796 | | 5/2006 |
| DE | 102005028618 | | 12/2006 |
| DE | 102007009457 | | 8/2008 |
| EP | 0496587 | | 7/1992 |
| EP | 0778018 | | 6/1997 |
| EP | 0778018 | | 11/1997 |
| EP | 0937655 | | 8/1998 |
| EP | 1068850 | | 10/2000 |
| EP | 1121922 | | 8/2001 |
| EP | 1194108 | | 4/2002 |
| EP | 1334045 | | 8/2003 |
| FR | 1418834 | | 11/1965 |
| FR | 2063745 | | 9/1971 |
| FR | 2169652 | | 9/1973 |
| FR | 2622424 | | 5/1989 |
| FR | 2680456 | | 2/1993 |
| FR | 2697331 | | 4/1994 |
| GB | 890770 | | 3/1962 |
| GB | 1017425 | | 1/1966 |
| GB | 2343440 | | 5/2000 |
| GB | 2351272 | | 12/2000 |
| GB | 2373710 | | 10/2002 |
| GB | 2375040 | | 11/2002 |
| GB | 2382020 | | 5/2003 |
| GB | 2383989 | | 7/2003 |
| GB | 2401025 | | 11/2004 |
| GB | 2418193 | | 3/2006 |
| GB | 2454230 | | 5/2009 |
| JP | 6278655 | | 5/1987 |
| JP | 01-084846 | A | 3/1989 |
| JP | 01084846 | | 3/1989 |
| JP | 1104271 | | 7/1989 |
| JP | 04082701 | | 3/1992 |
| JP | 4122213 | | 4/1992 |
| JP | 7255581 | | 10/1995 |
| JP | 9252911 | | 9/1997 |
| JP | 2000005024 | | 1/2000 |
| JP | 2000333811 | | 12/2000 |
| JP | 2001299552 | | 10/2001 |

| | | | |
|---|---|---|---|
| JP | 2005152558 | | 6/2005 |
| KR | 10-0740376 | | 7/2007 |
| KR | 100740376 | B1 | 7/2007 |
| NL | 1036045 | | 10/2009 |
| NZ | 516257 | | 7/2003 |
| SI | 9400348 | | 4/1996 |
| SI | 19600327 | | 6/1998 |
| WO | 9630272 | | 10/1996 |
| WO | 9703634 | | 2/1997 |
| WO | 9706073 | | 2/1997 |
| WO | 9713428 | | 4/1997 |
| WO | 9734816 | | 9/1997 |
| WO | WO9808751 | | 3/1998 |
| WO | 9819583 | | 5/1998 |
| WO | 9851259 | | 11/1998 |
| WO | 9903441 | | 1/1999 |
| WO | 9909871 | | 3/1999 |
| WO | 99/44482 | | 9/1999 |
| WO | 9961337 | | 12/1999 |
| WO | 0100134 | | 1/2001 |
| WO | 0136293 | | 5/2001 |
| WO | 0170080 | | 9/2001 |
| WO | 0232782 | | 4/2002 |
| WO | 03055435 | | 7/2003 |
| WO | 03086900 | | 10/2003 |
| WO | 2004063048 | A1 | 7/2004 |
| WO | 2005065498 | | 7/2005 |
| WO | 2005116590 | | 12/2005 |
| WO | 2006000376 | | 1/2006 |
| WO | 2006051305 | | 5/2006 |
| WO | 2006137674 | | 12/2006 |
| WO | 2007082034 | | 7/2007 |
| WO | 2007087357 | | 8/2007 |
| WO | 2008092200 | | 7/2008 |
| WO | 2009006690 | | 1/2009 |
| WO | 2009047821 | | 4/2009 |
| WO | 2010065980 | | 6/2010 |

OTHER PUBLICATIONS

Japanese Patent Office, Notice of Reason of Rejection for Application No. 2007-548642, Mailed Mar. 9, 2010, which contains a concise statement of relevance of Japanese references 62-78655 and 1-104271, 2 pages.

European Search Report dated Aug. 13, 2009 issued in corresponding EP Application No. 0480211.0.

U.S. Appl. No. 13/133,641, filed Jun. 8, 2011, entitled Dispensing Container, 65 pages.

U.S. Appl. No. 13/041,131, filed Mar. 4, 2011, entitled Fracturable Container, 42 pages.

* cited by examiner

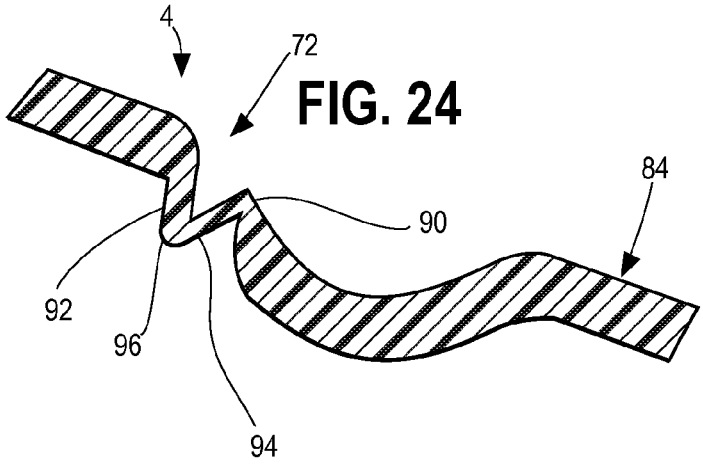
FIG. 24
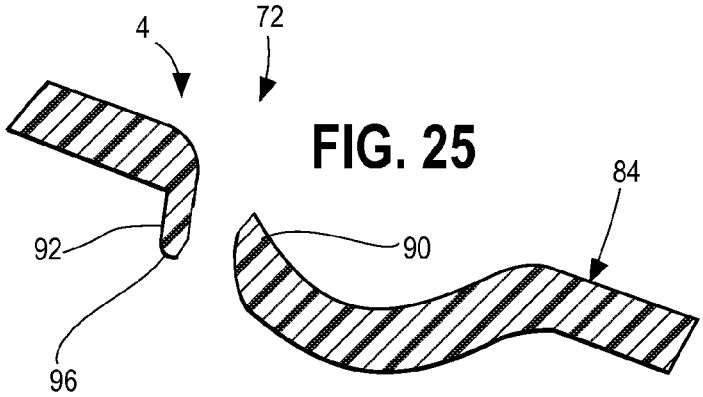
FIG. 25
FIG. 26
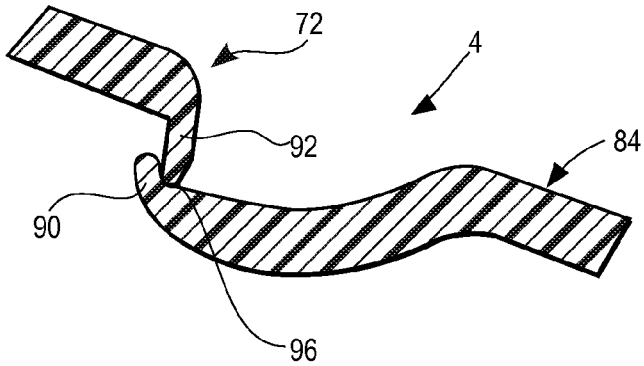

DISPENSING CONTAINER

FIELD

The invention relates to a container and, more particularly, to a reclosable container formed from a single component or multiple components and a method of making the same.

BACKGROUND

Containers of various sizes and shapes have long been used for packaging material. Generally, the style and configuration of packaging is selected based on packaging cost and the characteristics of material to be packaged.

Alternatively, when the material to be packaged is a liquid, has a granular consistency or includes a plurality of pieces, it may be preferable to have a sealed container which provides an internal cavity for the material to be stored and access to the cavity upon opening or rupturing the container. Further, with many materials, it may be desirable to provide a tamper evident feature to indicate whether or not the container has been previously opened.

A variety of tamper evident features have been employed in packaging. Exemplary tamper evident features include plastic wrapped about the container, a foil or paper seal secured to and extending across a container opening, and a removable cap having a break-off portion which cannot be reconnected to the removable cap after having been broken upon initial opening of the container.

As a result, the practice of packaging material within a sealed container and having a tamper evident feature requires multiple components which must be optimized and coordinated for the particular material to be packaged and potential environment of use. Further, a processor who packages various materials may be required to stock different containers and tamper evident features for each different material to be packaged.

In addition, given the variety of tamper evident features used in packaging today, a consumer may have difficulty ascertaining whether a product has been opened for the first time. For example, as noted above, some tamper evident features include only a thin plastic wrap around a portion of the container, while some may use a seal under a removable cap, and some may use both. As a result, it can be difficult for consumers to ascertain by a quick visual examination whether a container has been opened for a first time. Another consideration in the ease of being able to open the container, particularly upon initial opening which requires overcoming the tamper evident feature as well. For example, shrink wrap and seal types of tamper evident features can be extremely difficult to remove particularly to those with limited dexterity.

It also is important to extend consideration to being able to recycle discarded containers. Recycling is made more difficult by containers made of multiple components because the different components are made from different materials.

BRIEF DESCRIPTION OF THE DRAWINGS

FIG. 24 is a detail view of the lid showing an intact frangible portion;

FIG. 25 is a detail view of the lid of FIG. 24 showing a tab defined by the fractured frangible portion;

FIG. 26 is a detail view of the lid of FIG. 24 showing a lip of the tab positioned within a cavity of the container;

DETAILED DESCRIPTION OF THE PREFERRED EMBODIMENTS

Figure 1:
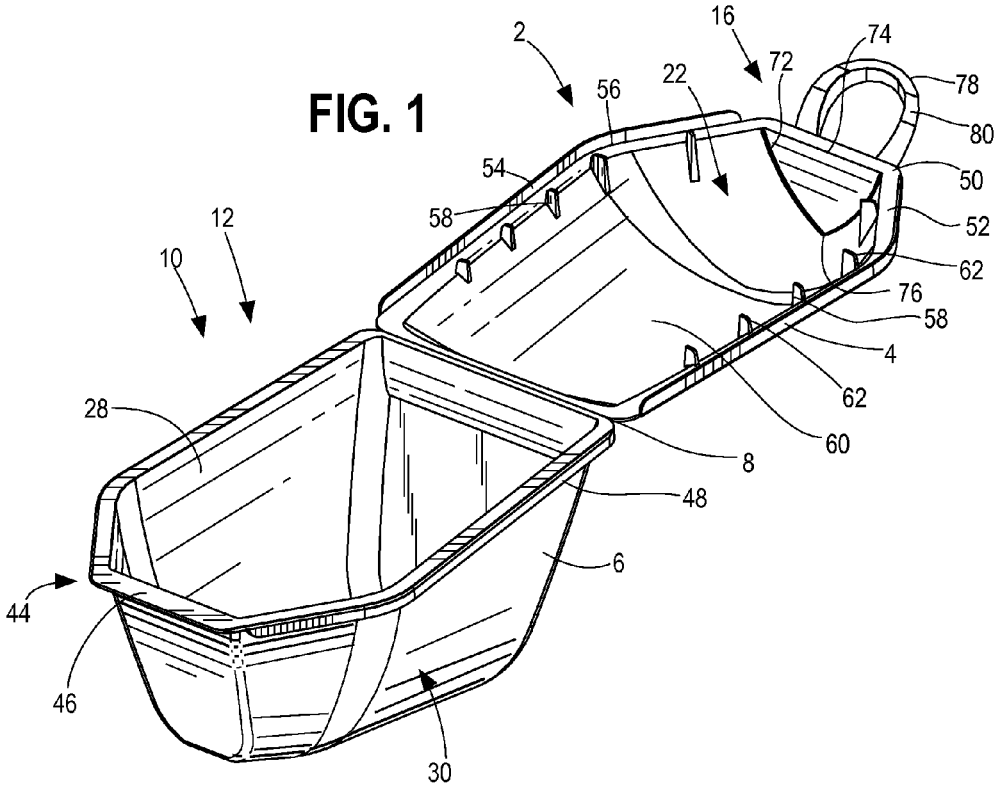
FIG. 1 is a perspective view of a container with a base and lid in an open configuration.

As shown in FIGS. 1-10, a container 2 for storing material, such as liquids or solid pieces, is disclosed. The container 2 includes a lid portion 4, a base portion 6 and a hinge portion 8 therebetween. The container 2 is formed as a unitary or single component 10. The lid 4 and base 6 can be shifted about the hinge portion 8 between an open configuration 12, as shown in FIGS. 1-4, and a closed configuration 14, as shown in FIGS. 6-10. The container 2 can be sealed in the closed configuration 14 such that, if the container 2 is shifted back toward the open configuration 12 so as to disrupt the seal, the container 2 cannot be readily sealed back in the closed configuration 14. More particularly, the container 2 is not intended to be opened by separating the lid 4 and base 6 after the lid 4 and base 6 have been sealed together. To access the material stored within the container 2, the container 2 includes an opening panel 16 that covers a dispensing port for expelling the contents from the container 2.

As shown in FIGS. 1-10, both the lid portion 4 and the base portion 6 have a concave configuration 18 and 20, which face one another in the closed configuration 14, creating an internal sealed cavity 15 therebetween. However, it is noted that either of the lid and base portions 4 and 6 can have a flat configuration or a convex configuration such that, in the closed configuration 14, the convex shaped portion would extend into the concave shaped portion of the other half. In any configuration, a cavity 15 is to be formed between the lid and base portions 4 and 6.

Both the size and the configuration of the lid and base portions 4 and 6 can be optimized depending on the material to be stored or for aesthetic purposes. For example, the lid and base portions 4 and 6 can be configured to provide 200 cubic centimeters or 400 cubic centimeters of space and have various geometrical configurations.

Figure 2:
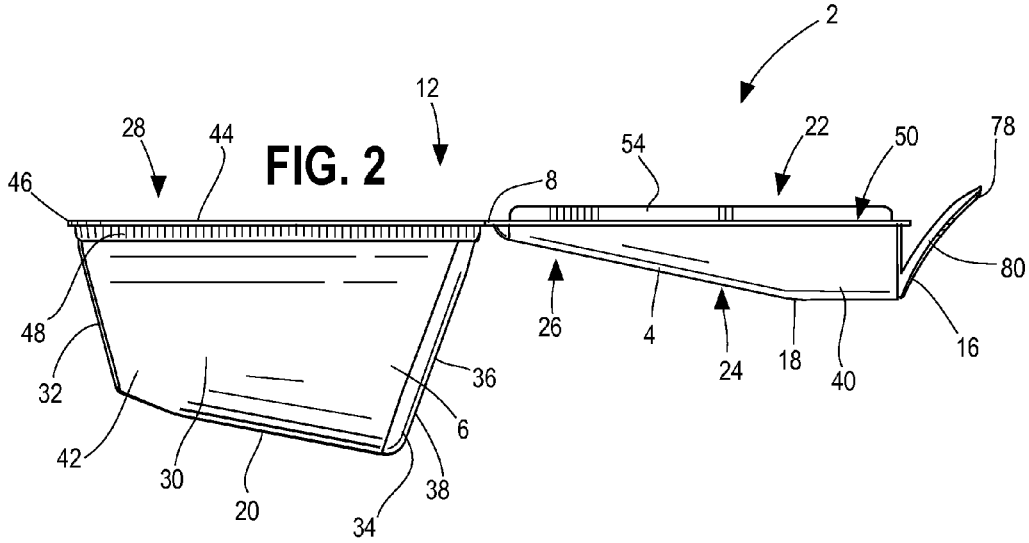
FIG. 2 is a side elevational view of the container of FIG. 1.
Figure 3:
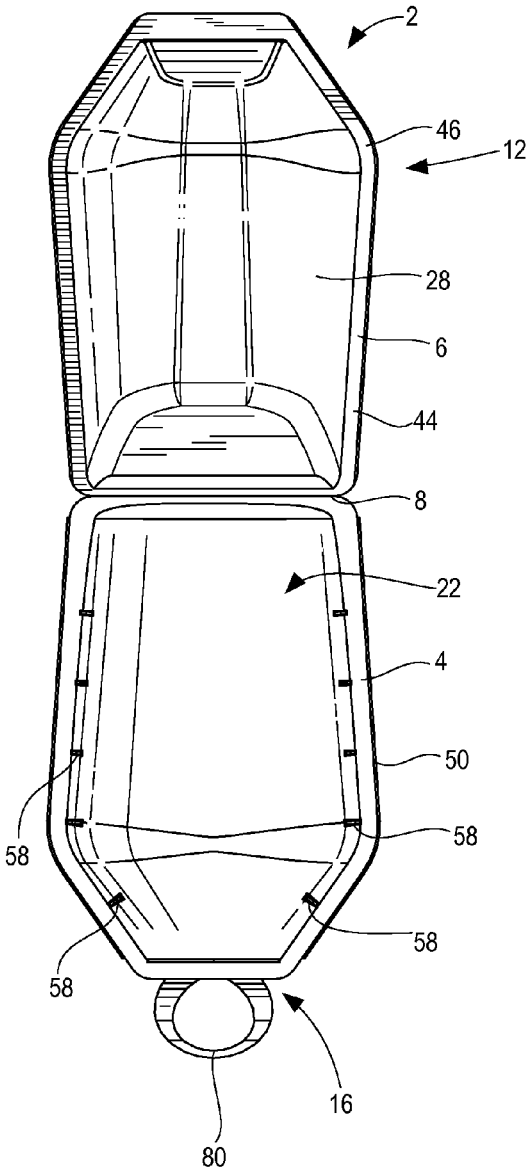
FIG. 3 is a top plan view of the container of FIG. 1.
Figure 4:
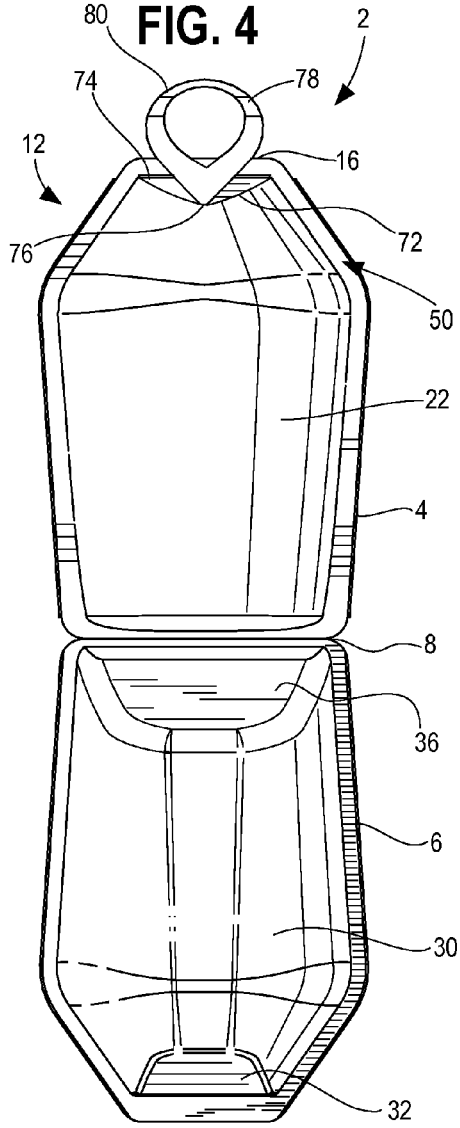
FIG. 4 is a bottom plan view of the container of FIG. 1.

As shown in FIG. 1, the lid portion 4 includes a curved wall portion 24 defining an opening 22 and the curvature of the lid portion 4. As shown in FIG. 2, the curved wall 24 tapers along the lid portion 4 towards the hinge portion 8. Opposite the tapered end 26 of the lid portion 4 is the opening panel 16. It, however, is contemplated that the opening panel 16 may be located at alternative locations on the lid portion 4 of the container 2 or even on the base portion 6 of the container 2.

Figure 9:
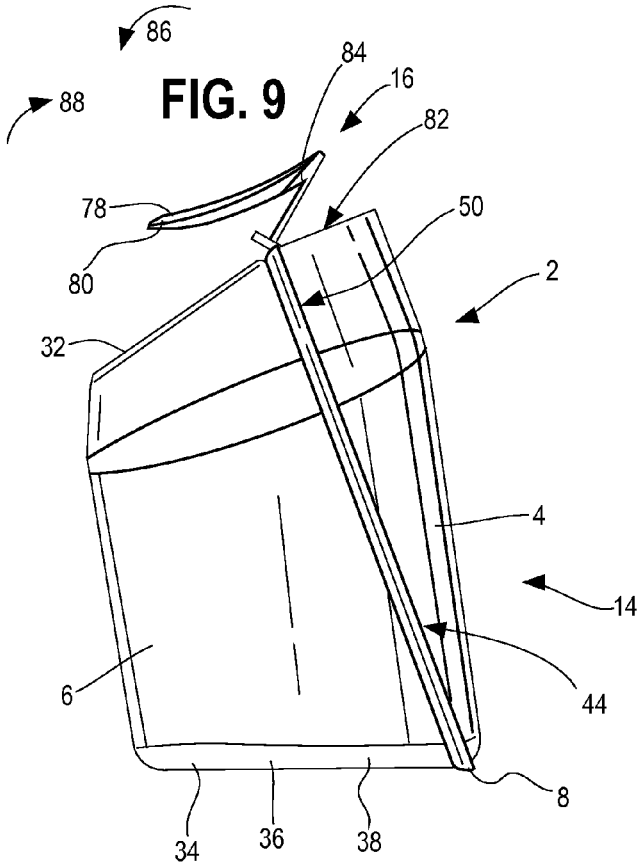
FIG. 9 is a side elevational view of the container of FIG. 1 with the container in the closed configuration and an opening panel in a partially open orientation.
Figure 10:
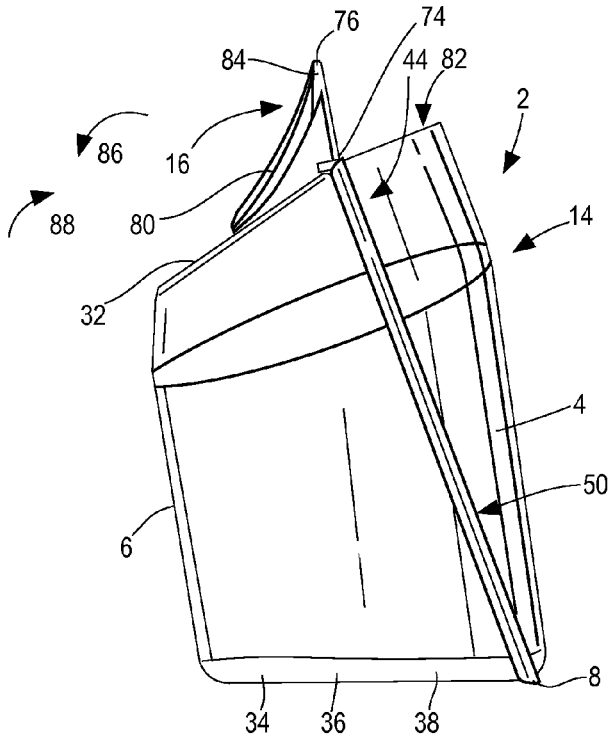
FIG. 10 is a side elevational view of the container of FIG. 1 with the container in the closed configuration and the opening panel in a fully open dispensing configuration.

The base portion 6, as shown in FIGS. 1-10, includes a curved wall portion 30 defining an opening 28 and the curvature of the base portion 6. As shown in FIG. 2, the curved wall 30 can be tapered along the length of the base portion 6. As shown in FIG. 2, the curved wall 30 is tapered from a smaller end 32 toward a larger end 34 adjacent the hinge portion 8. As such, the tapered configuration can be used to accommodate a larger end portion 34. As shown in FIGS. 9 and 10, the larger end 34 includes a surface 36 configured to allow the container 2 to stand on the surface 36 in an upright orientation for being displayed or stored. The base surface 36 has a flat configuration 38; however, other configurations which permit the container 2 to balance thereon are contemplated.

Figure 14:
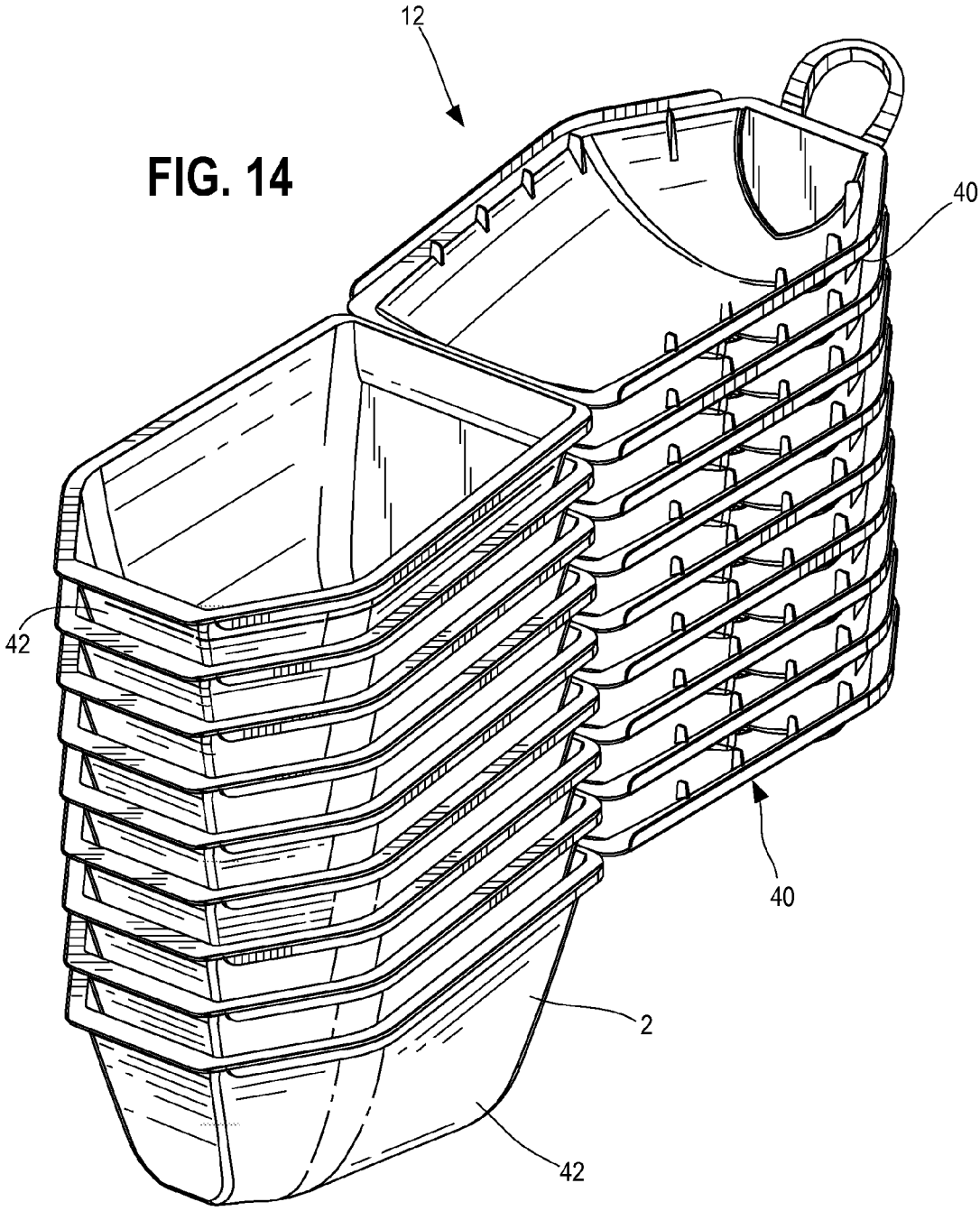
FIG. 14 is a perspective view of the container of FIG. 1 showing nine empty nested containers.
Figure 30:
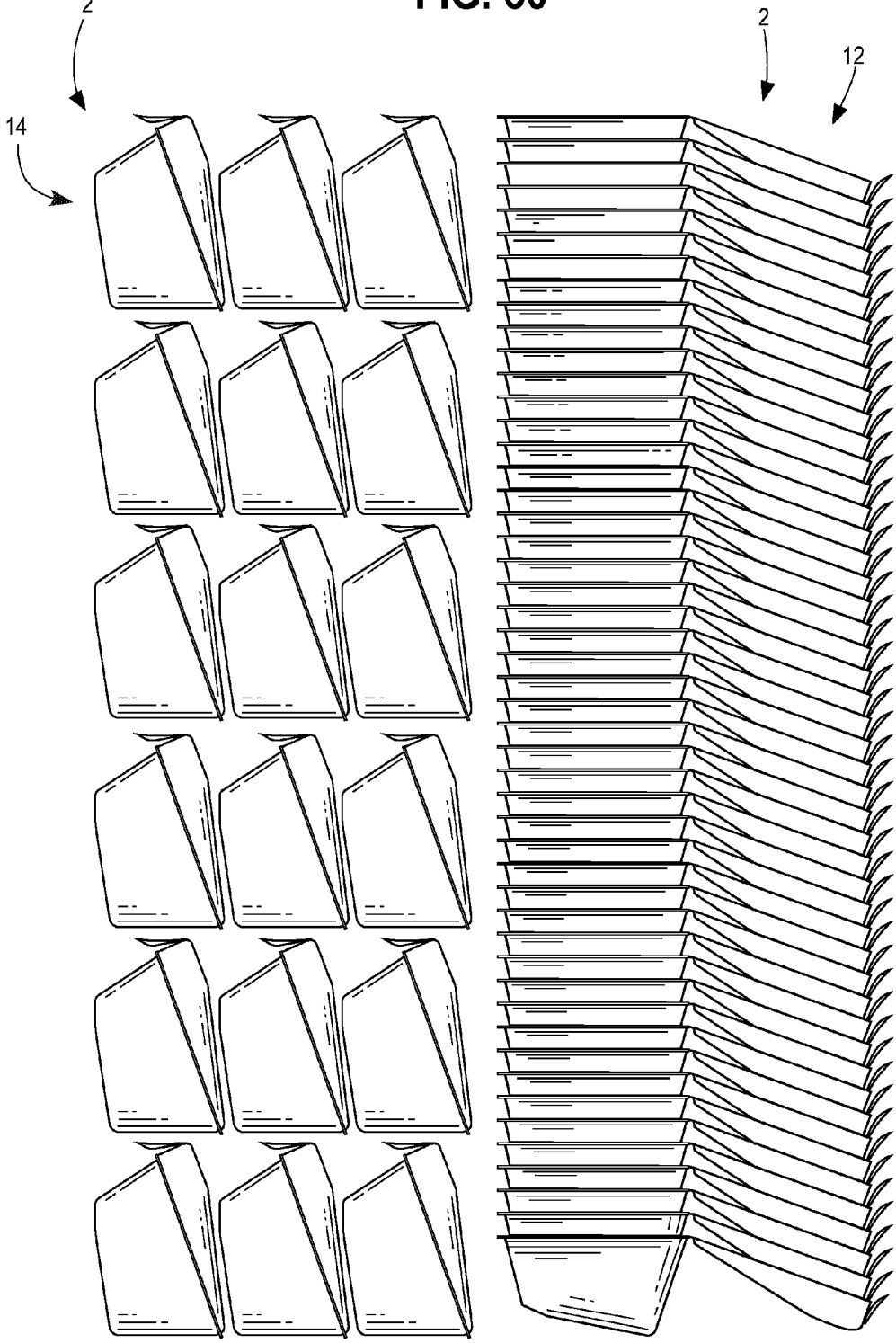
FIG. 30 is a side elevational view comparing the space requirements of the sealed containers and unsealed nested containers.

The container 2 is produced as an open single component piece that can be stacked in a nested configuration for transport from manufacturing to a filling operation. More specifically, as shown in FIG. 14, the lid and base portions 4 and 6 of the container 2 can be configured to nest in an identical container 2 or allow an identical container 2 to be nested therein. In particular, outer surfaces 40 and 42 of the lid and base portions 4 and 6, respectively, can be configured to be received in the openings 22 and 28 of the lid and base portions 4 and 6, respectively, allowing the containers 2 to be stacked in the open configuration 12. As a result, the containers 2 can be densely packed and stored prior to filling. Further, the configurations of the outer surfaces 40 and 42 and the openings 22 and 28 are sized relatively to one another such that the containers 2 can be easily removed when nested with other like containers 2. This nesting of the containers for transport can decrease transport volume required by 60-90% over typical jars and lids. As shown in FIG. 30, for example, fifty nested containers 2 can be stored in the space which would be occupied by eighteen identical containers 2 in the closed configuration 14.

About the perimeter of the opening 28 of the base portion 6 is a lower flange 44. As shown in FIGS. 1, 2, 5, 6, 11 and 12, the lower flange 44 includes a rim portion 46 and a skirt portion 48. The rim 46 extends generally orthogonal to the curved wall 30 of the base portion 6. The skirt 48 extends generally orthogonal to the rim 46 along the curved sidewall 30 of the base portion 6, except along the hinge 8 and the opening panel 16.

Figure 5:
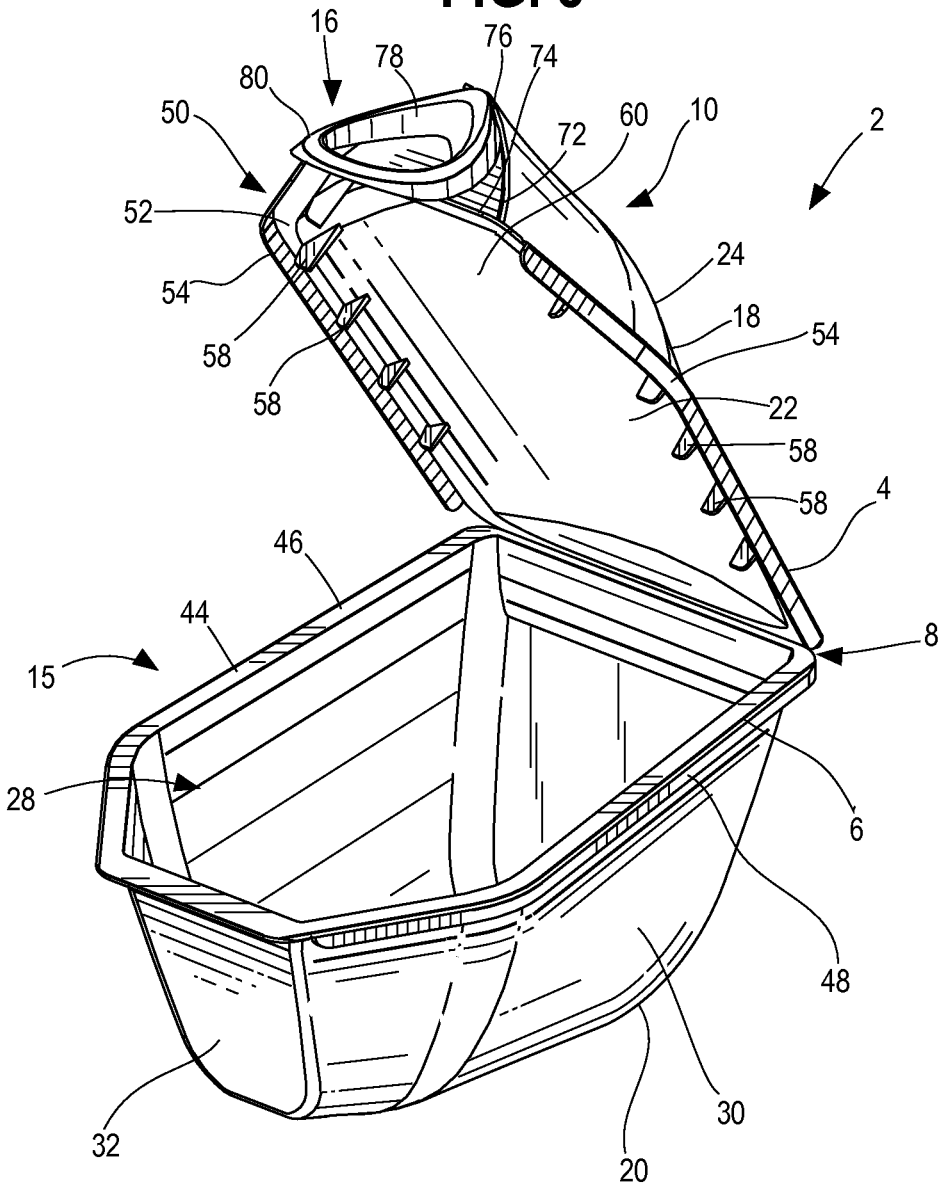
FIG. 5 is a perspective view of the container of FIG. 1 with the base and lid of the container in an intermediate configuration.
Figure 6:
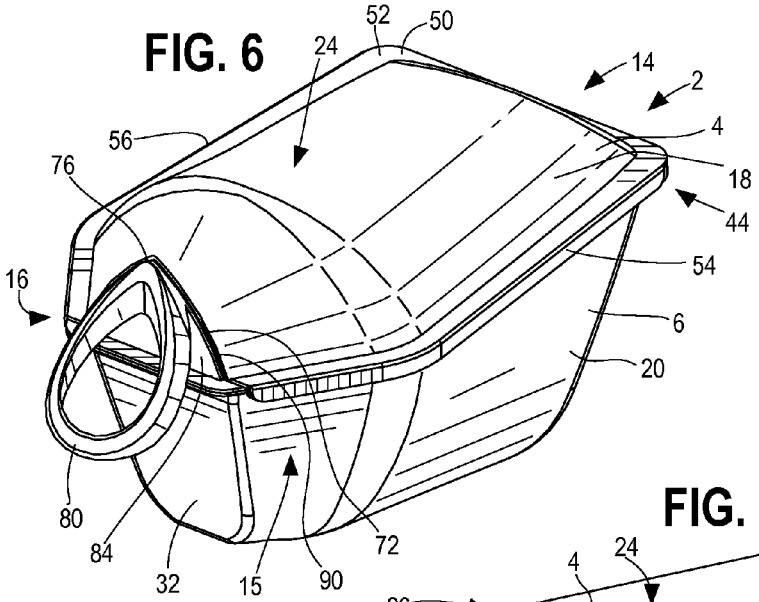
FIG. 6 is a perspective view of the container of FIG. 1 with the base and lid of the container in a closed configuration.

The lid portion 4 includes an upper flange portion 50 extending about the perimeter of the opening 22 and corresponding to the lower flange 44. A rim portion 52 of the upper flange 50 has a width which generally corresponds to the width of the rim 46. An upper skirt portion 54 extends along an outer edge 56 of the rim 52 and corresponds to the skirt 48 of the lower portion 6. Guide posts 58 extend from an inner surface 60 of the lid portion 4. The guide posts 58 are configured to guide the flange 44 of the base portion 6 so that the lower rim 46 engages the upper rim 52 and the lower skirt portion 48 engages the upper skirt portion 54. As shown in FIGS. 1 and 5, the guide posts 58 can include a curved or tapered terminal edge 62 upon which the lower flange can slide to further ease the lower flange 44 into engagement with the upper flange 50.

To provide a tamper evident feature the flanges 44 and 50 are sealed together to form a seal 64. Once the seal 64 is formed between the flanges 44 and 50 with the lid and base portions 4 and 6 in the closed configuration 14, separating the upper and lower flanges 44 and 50 breaks the seal 64. As previously discussed, the seal 64 is not intended to be resealable.

Figure 11:
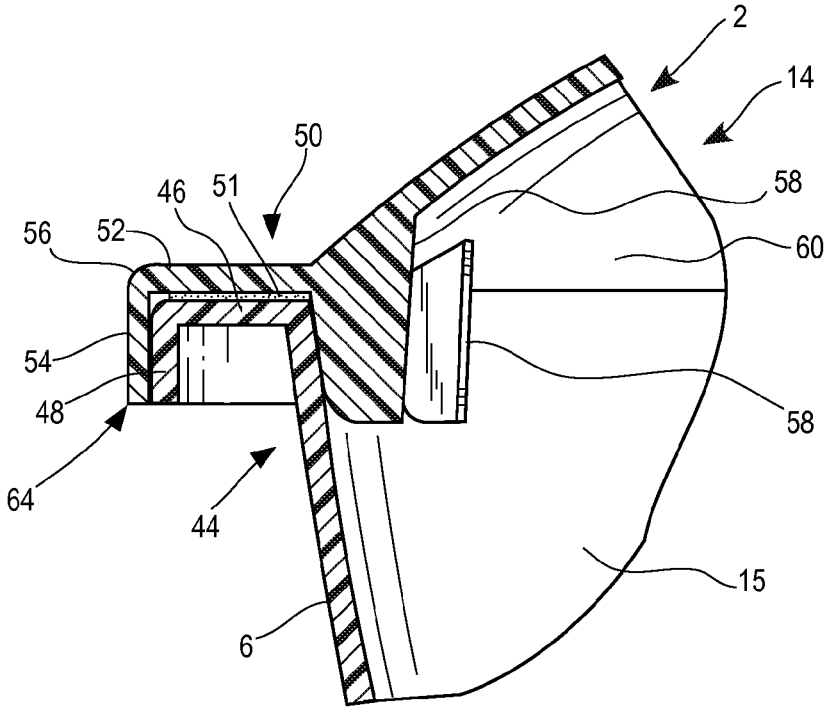
FIG. 11 is a detail view of the container of FIG. 1 with the container in the closed configuration showing the interaction between the base and the lid.

In one embodiment, as shown in FIG. 11, the flanges 44 and 50 are slip fit with one another such that prior to applying the seal 64 the flanges 44 and 50 can be engaged and disengaged without structural failure. In lieu of a mechanical locking engagement, the flanges 44 and 50 of the upper and lower portions 4 and 6 can be secured in place by other methods. In particular, an adhesive 51 can be used to from the seal 64 to lock the flanges 44 and 50 of the lid and base portions 4 and 6 together. Other methods of sealing the flanges 44 and 50 of the lid and base portions 4 and 6 include the use of heat, ultrasonic welding, or any other known method or process of sealing members or portions to one another.

Figure 12:
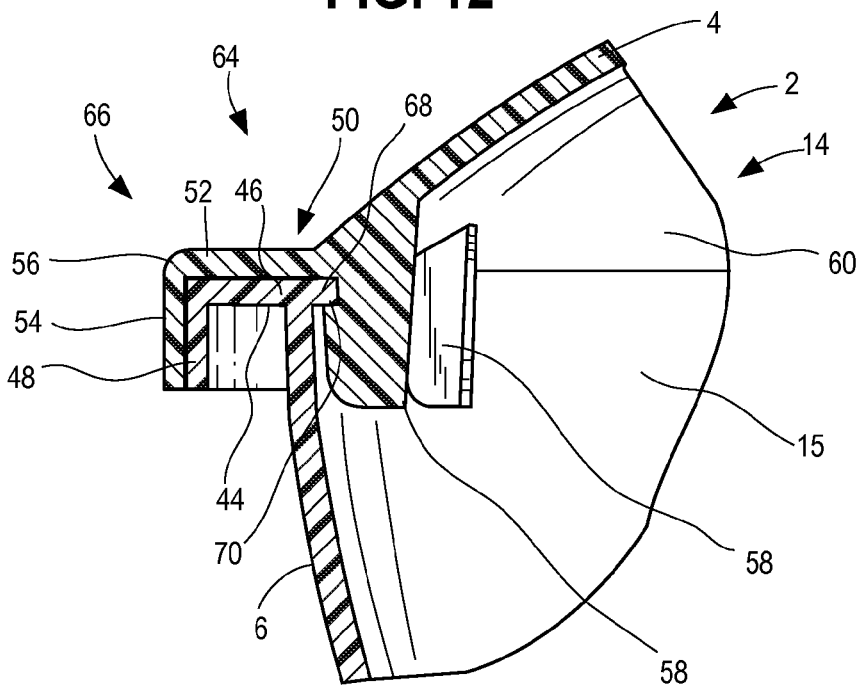
FIG. 12 is a detail view of the container of FIG. 1 with the container in the closed configuration showing a mechanical interengagement seal between the base and the lid.

In an alternative embodiment, as shown in FIG. 12, the seal 64 can be a mechanical seal 66 between the upper and lower flanges 44 and 50. The mechanical seal 66 includes an inner extension 68 of the rim 46 of the lower flange 44. The guide posts 58 of the upper portion 6 include a cut-out 70 extending from below the rim 52 of the upper flange 50 and corresponding to the inner extension 68 of the lower flange 44. As a result, engaging the lower flange 44 with the upper flange 50 to create the mechanical seal 66 requires an application of force sufficient to urge at least one of the guide posts 58 and the upper skirt 54 away from the lower flange 44 to permit the inner extension 68 to shift along the guide post 58 and be snapped into the guide post cut-out 70, thereby mechanically locking the upper and lower flanges 44 and 50. Subsequent separation of the upper and lower flanges 44 and 50 results in guide post 58 or upper skirt 54 failure, which would further not allow for a future mechanical seal 66 between the upper and lower portions 4 and 6. The mechanical seal 66 can be formed by a number of the guide posts 58 each having a cut out 70 to receive the inner extension 68.

Figure 13:
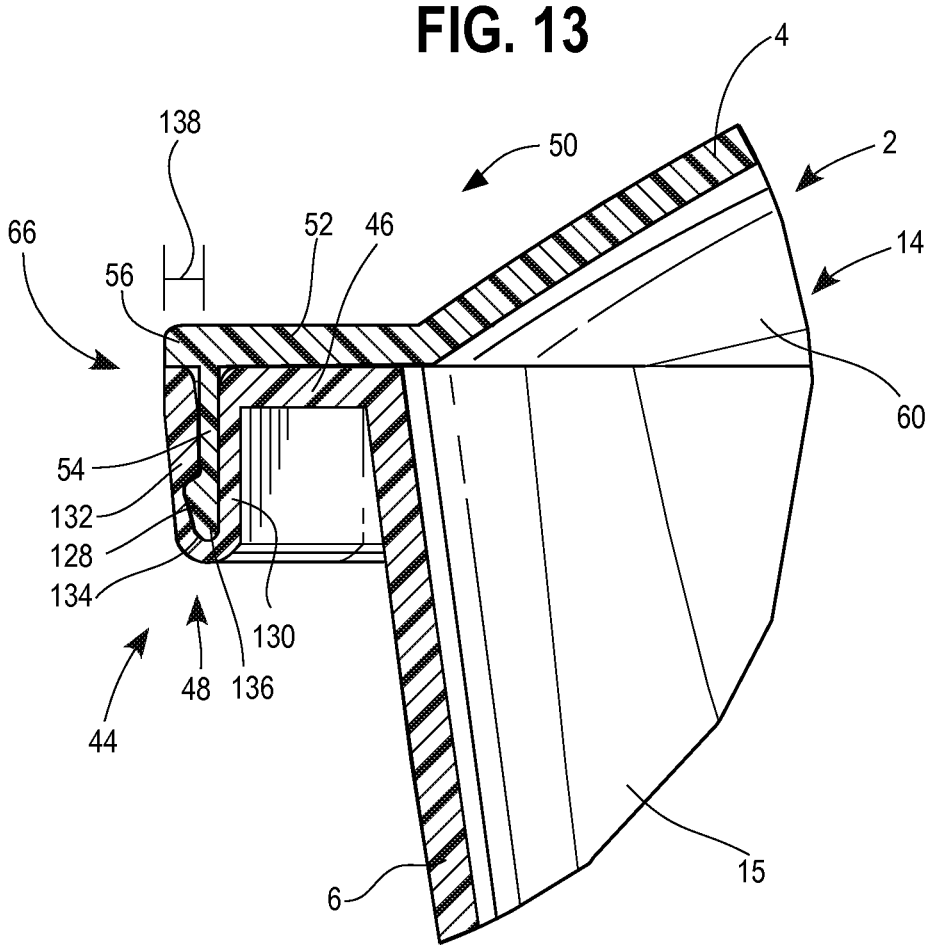
FIG. 13 is a detailed view of the container of FIG. 1 with the container in the closed configuration showing an alternative mechanical interengagement seat between the base and lid.

In another alternative embodiment, as shown in FIG. 13, the seal 64 can be a mechanical seal 66 between the upper and lower flanges 44 and 50. The mechanical seal 66 includes an enlarged distal head portion 128 of the lower skirt 54. As shown in FIG. 13, the lower skirt 54 extends downward from the flange rim 52 at a distance 138 inward from the flange rim distal edge 56. The enlarged head portion 128 is configured to be secured between spaced portions 130 and 132 of the lower skirt 48. The spaced portions 130 and 132 are spaced from each other a distance less than the size of the enlarged head portion 128 and include an enlarged cavity 134 at the bottom of the lower skirt 48. The enlarged cavity 134 is sized to securely receive the enlarged head portion 128 of the upper skirt 54 therein. To insert the enlarged head portion 128 into the cavity, the enlarged head portion 128 includes a tapered leading edge 136 to urge the spaced skirt portions 130 and 132 away from one another an amount sufficient to permit the enlarged head portion 128 to be received in the enlarged cavity 134, thereby mechanically locking the upper and lower flanges 44 and 50. Subsequent separation of the upper and lower flanges 44 and 50 results in failure of the spaced skirt portions 130 and 132 and/or enlarged head portion 128, which would not allow for a future mechanical seal 66 between the lid and base portions 4 and 6. While not shown, guide posts of the lid 4 can be used to align the mating of the lid and base portions 4 and 6, as described above.

The contents being stored inside the container 2 depends on the size of the container 2 and the opening panel 16 and the compatibility of the materials of the container with the contents to be stored. As indicated above, liquids and solids can be stored in the container. The size of the opening panel 16 can be optimized depending on the viscosity of the fluid, the size of the particles, or the desired flow rate through the dispensing port formed by opening the opening panel 16.

As shown in FIGS. 1-10, the opening panel 16 includes a weakened, frangible portion 72 of the lid 4 of the container 2. Exemplary dispensing ports are disclosed in D560,442 to Teys et al., D560,443 to Teys et al., D570,164 to Teys et al., D572,089 to Teys et al., and U.S. patent application Ser. No. 11/771,372 to Teys et al., which issued as U.S. Pat. No. 8,091,242 on Jan. 10, 2012, which are hereby incorporated by reference as if included in their entirety herein.

The frangible portion 72 extends from the upper flange 50, toward the curved wall portion 24, and back to the upper flange 50. As shown in FIG. 1 the frangible portion has a wide base 74 adjacent the upper flange 50 and tapers to a pointed distal end 76 away from the upper flange 50. As shown in FIGS. 2 and 4-8, a force application member 78, such as a ring-shaped handle 80, extends from the pointed distal end 76 and provides a user a graspable handle to pull to exert a concentrated force upon the frangible portion 72. The pulling acts as a lever to easily maximize and concentrate the opening force. As the force applied overcomes the strength of the frangible portion 72, the frangible portion 72 breaks or fractures therealong, creating an opening 82 into the sealed cavity 15.

Figure 7:
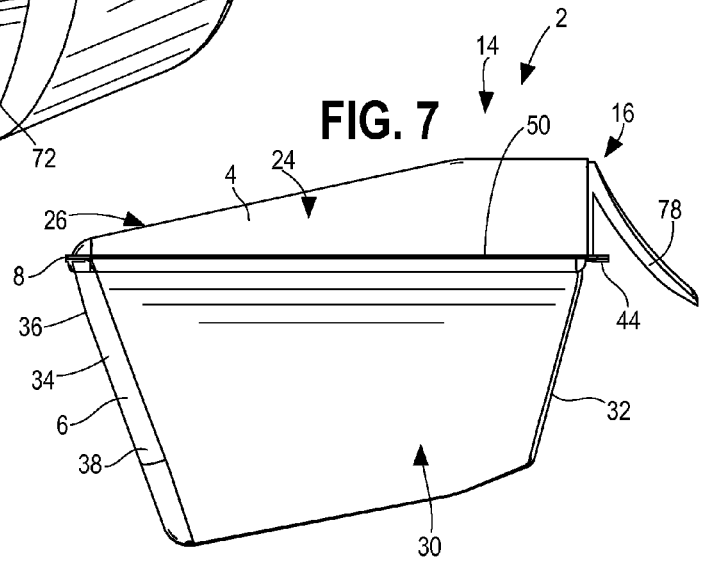
FIG. 7 is a side elevational of the container of FIG. 1 with the container in the closed configuration.
Figure 8:
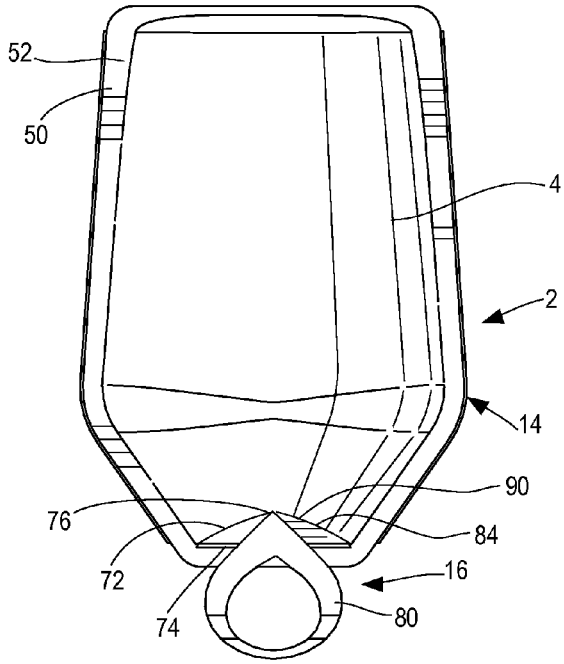
FIG. 8 is a top plan view of the container of FIG. 1 with the container in the closed configuration.

As shown in FIGS. 7, 9 and 10, tab portion 84 of the opening panel 16, defined by the fractured frangible portion 72, extends along the lid portion 4 toward the upper flange 50. Preferably, the upper flange 50 remains intact and acts as a hinge while the tab portion 84 is shifted outwardly 86 to provide the opening 82 into the cavity 15. More specifically, as the tab portion 84 is shifted outwardly 86, a portion of the flange 50 which intersects with the fractured frangible portion 72 bends or deforms with the movement of the tab portion 84. Further, as the tab portion 84 is shifted inwardly 88, the outer edge 90 of the tab portion 84 can interact with the remainder of the frangible portion 72 about the opening 82 to close the opening 82 so that the remaining contents are closed in the cavity 15. As a result, the tab portion 84 can be used to manipulate the opening panel 16 to open and close the opening 82 throughout the useful life of the container 2. This allows a user to dispense a specific amount of the contents within the cavity 15, with the rest being safely stored within the container cavity 15.

Figure 15:
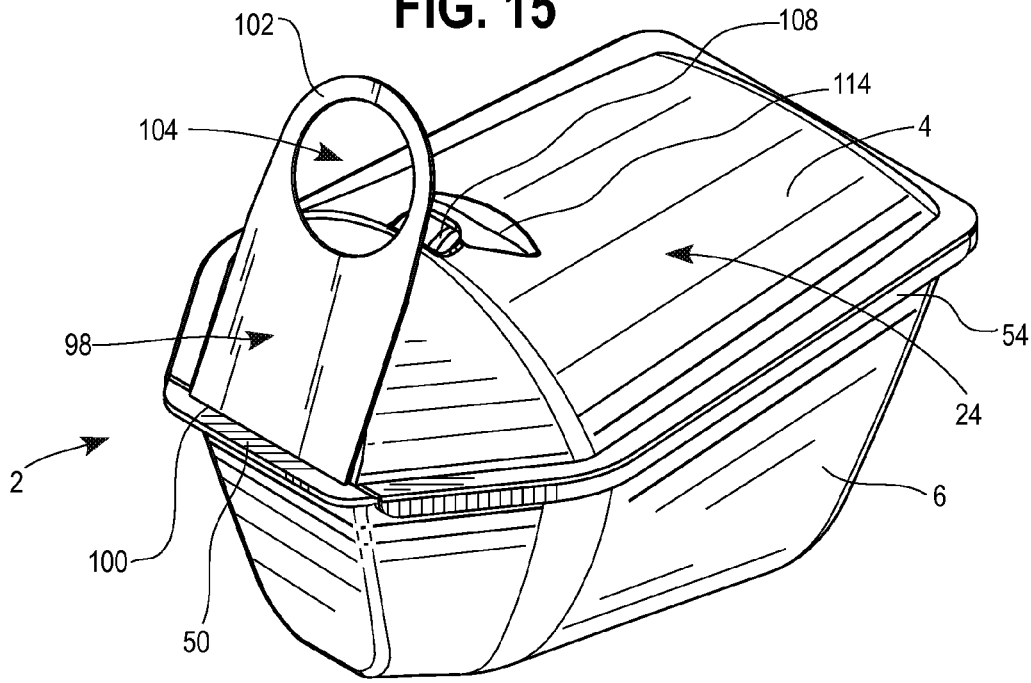
FIG. 15 is a perspective view of a second container embodiment with a base and a lid in a closed configuration.
Figure 16:
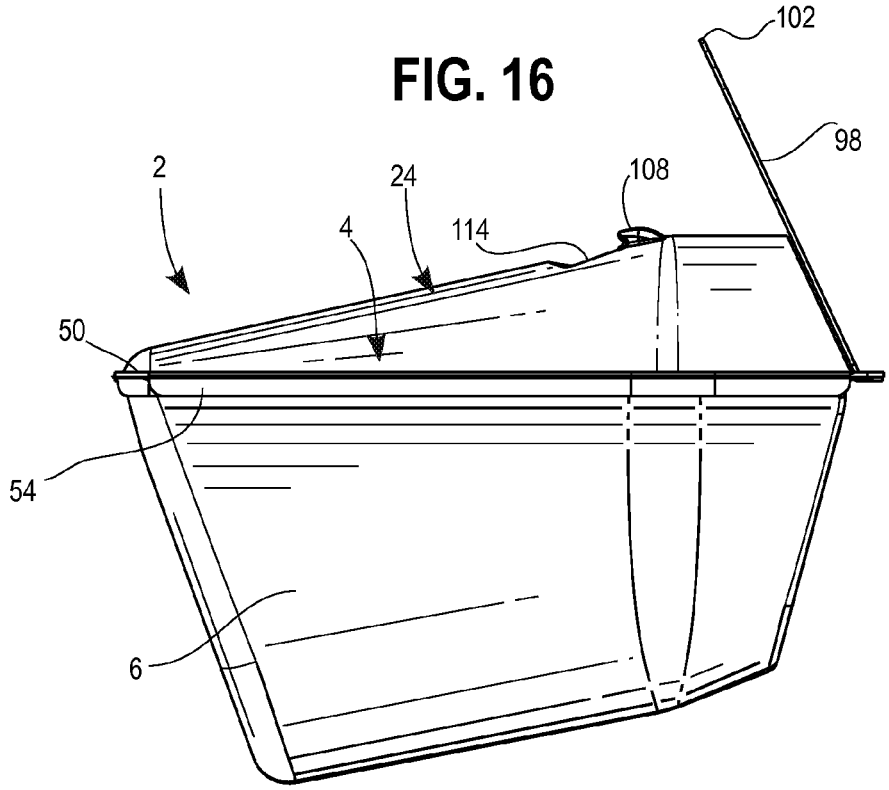
FIG. 16 is a side elevational view of the container of FIG. 15 with the base and the lid in the closed configuration.
Figure 17:
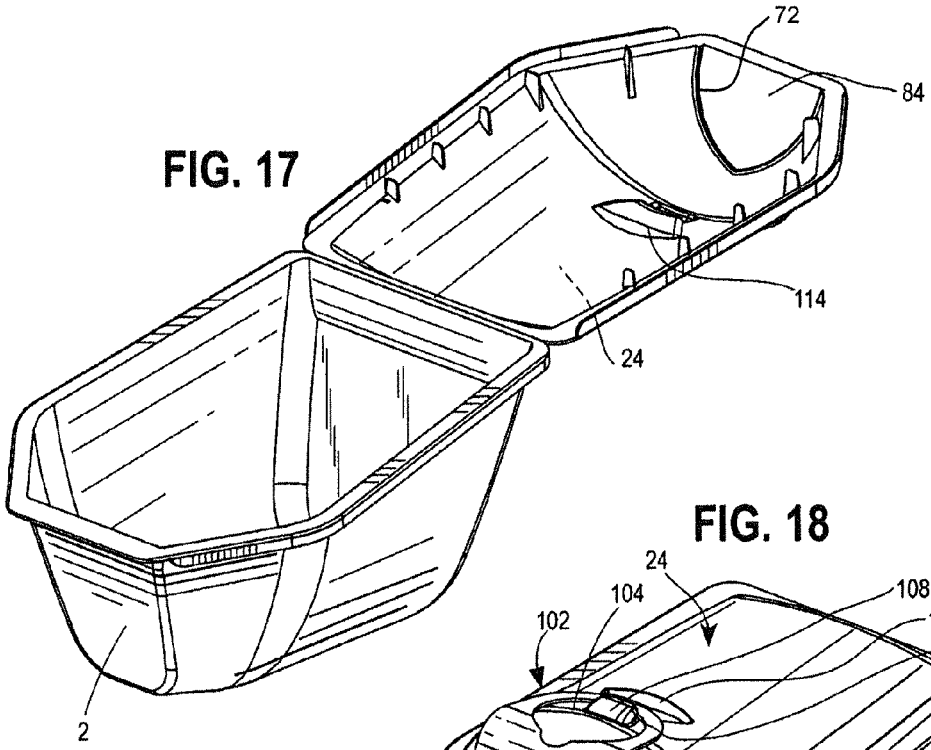
FIG. 17 is a perspective view of the container of FIG. 15 with the base and the lid in the open configuration and a distal end of a panel secured to the upper surface of the lid.

In a second embodiment, as shown in FIGS. 15-20, opening panel 16 includes a flap portion 98 affixed to the tab 84 that can lock to the top of the lid, as described below. In all other material respects, this container is the same as that described above. As shown in FIGS. 15 and 16, the flap portion 98 is connected at one end 100 to the upper flange 50 and includes a graspable distal end 102 having an opening 104 therethrough. Preferably, the flap portion 98 is formed as a single piece with the lid 4 and the base 6. An inner surface 106 of the flap 98 is secured to the tab portion 84, such as by an adhesive, heat adhesion, or ultrasonic welding. As a result, as the distal end 102 of the flap portion 98 is pulled to pivot outwardly 86 to cause the frangible portion 72 of the lid 4 to fracture or break as discussed above.

Figure 18:
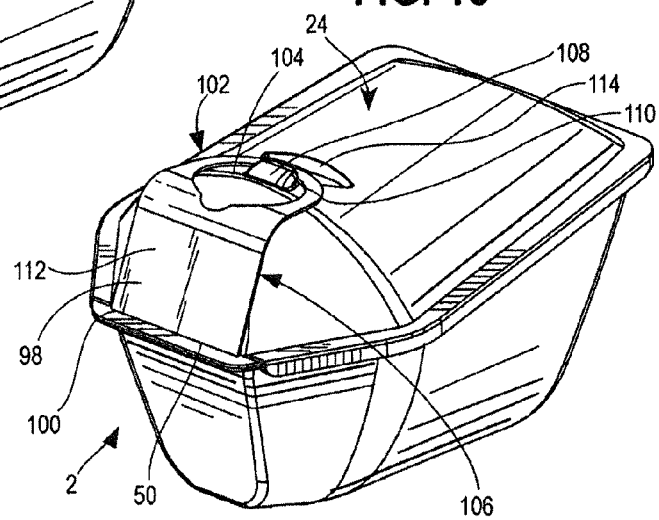
FIG. 18 is a perspective view of the container of FIG. 15 with the base and the lid in the closed configuration and the distal end of the panel secured to the lid.
Figure 19:
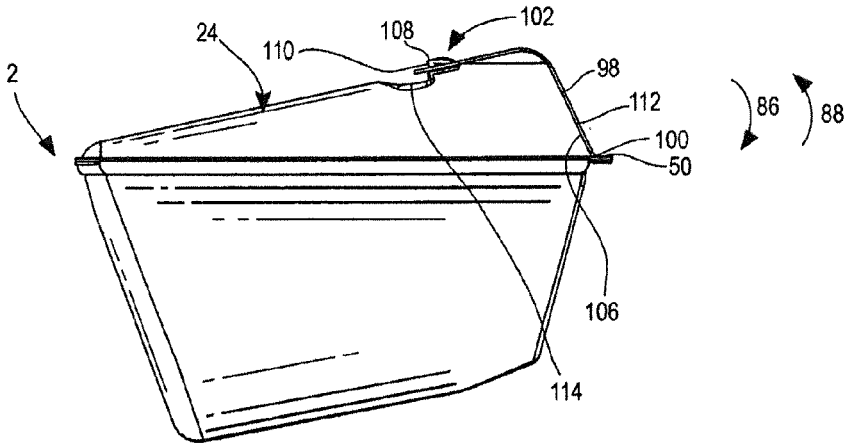
FIG. 19 is a side elevational view of the container of FIG. 15 with the base and the lid in the closed configuration and the distal end of the panel secured to the lid.

As shown in FIGS. 18 and 19, the flap portion 98 can be shifted toward the tab 84 by pulling the distal end 102 of the flap portion 98 to pivot inwardly 88 toward the lid 4. The lid 4 includes a hitch portion 108 formed and extending from the surface 24 of the lid 4 and provides a securing location for distal end 102 of the flap 98. As shown in FIGS. 18 and 19, an inner portion 110 of the opening 104 of the flap 98 can be positioned around a portion of the hitch 108, thereby securing the flap 98 in place. As a result, the tab 84 and the flap 98 close the opening 82 of the lid 4. If desired, a force can be applied against a central portion 112 of the flap 98 to ensure that tab 84 has closed the opening 82.

As shown in FIGS. 15-19, adjacent the hitch 108 of the lid 4 is a recessed portion 114. The recessed portion 114 provides a user with a gap between the curved surface 24 of the lid 4 and the distal end 102 of the flap 98, thereby allowing a user to grasp the flap 98 and shift the flap 98 toward an open configuration.

Figure 20:
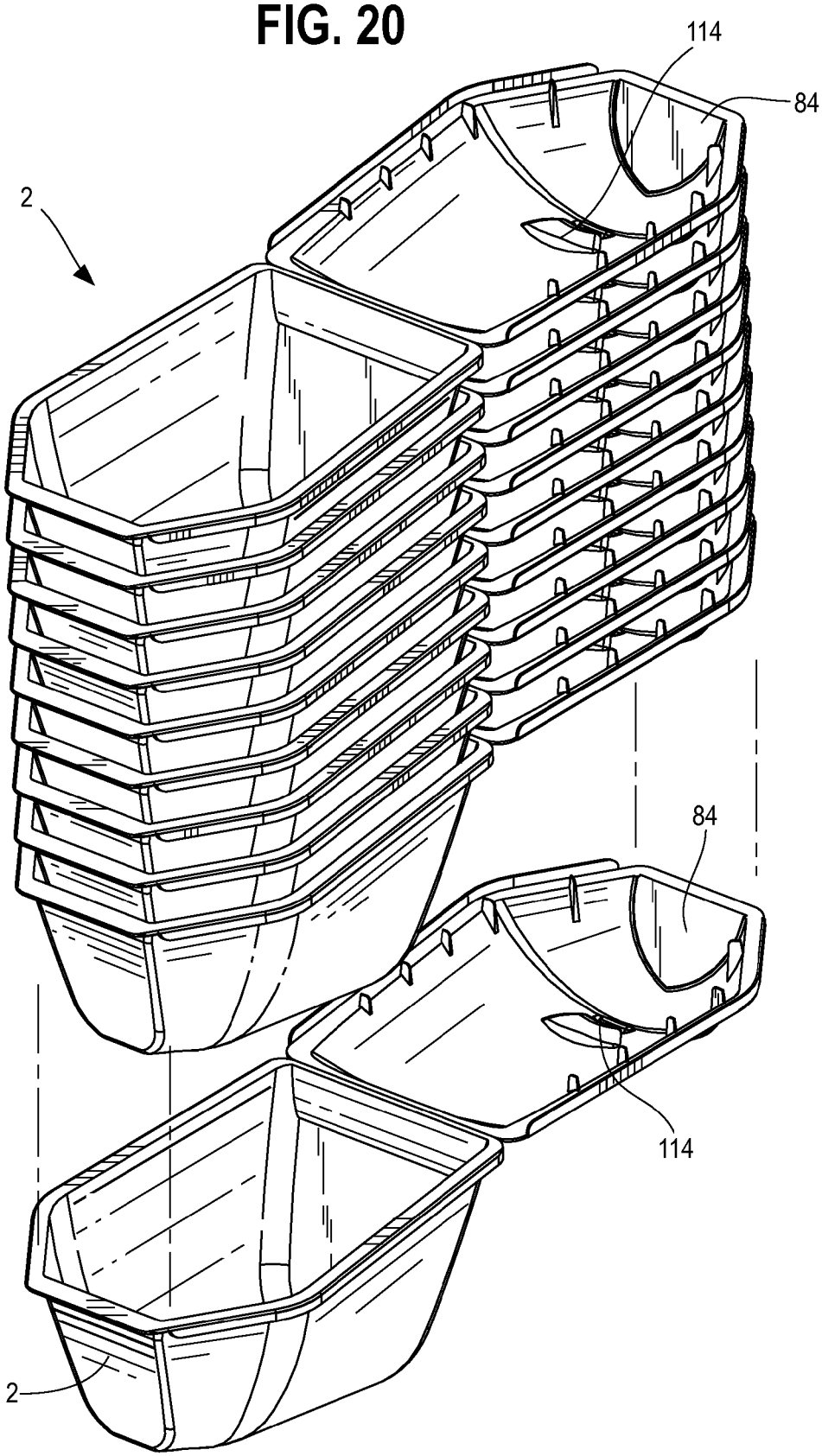
FIG. 20 is a perspective view of the container of FIG. 15 showing 9 nested containers and one unnested container and the distal end of the panel secured to the lid.

As shown in FIG. 20, the container 2 of FIGS. 15-19 can be nested, such as shown in FIG. 14. Preferably, the flap portion 98, hitch 108 and recess 114 are configured to minimize the space occupied while like containers are nested.

Figure 21:
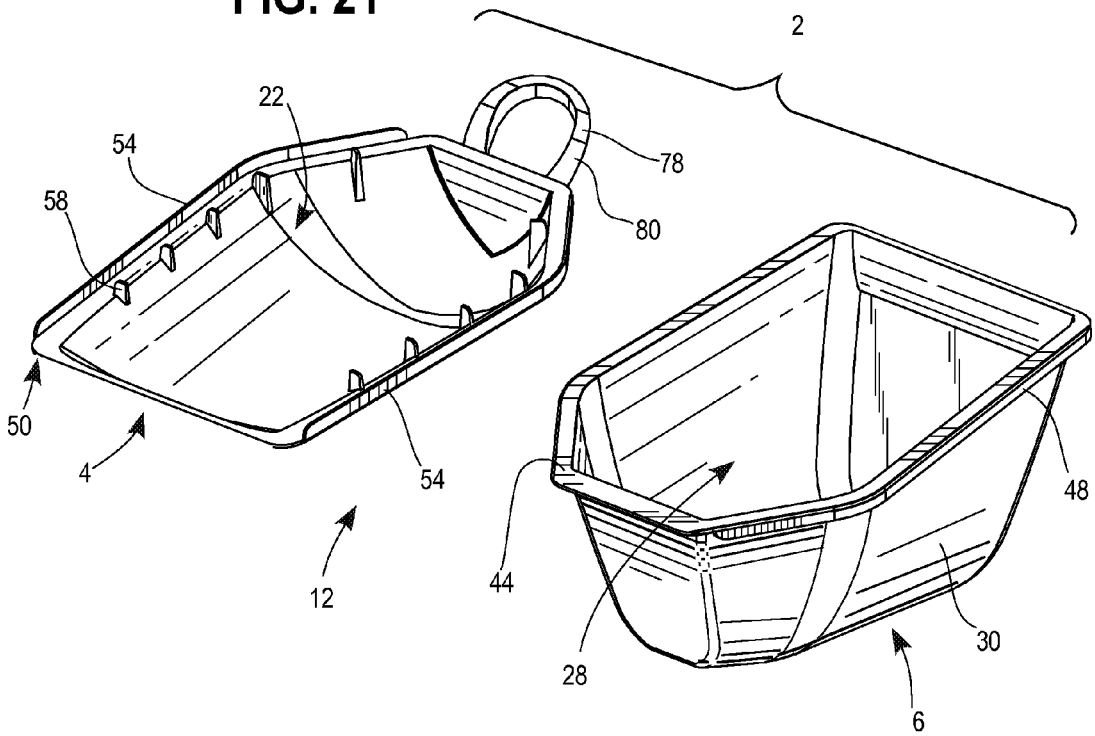
FIG. 21 is a perspective view of a third container embodiment with a base and a lid in an open configuration.
Figure 22:
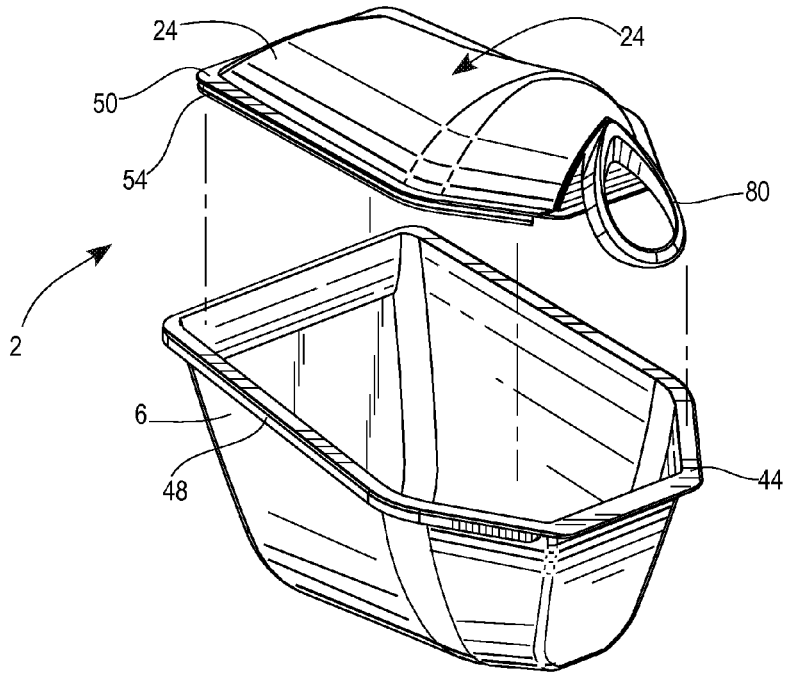
FIG. 22 is an exploded perspective view of the container of FIG. 21 in the closed configuration.
Figure 23:
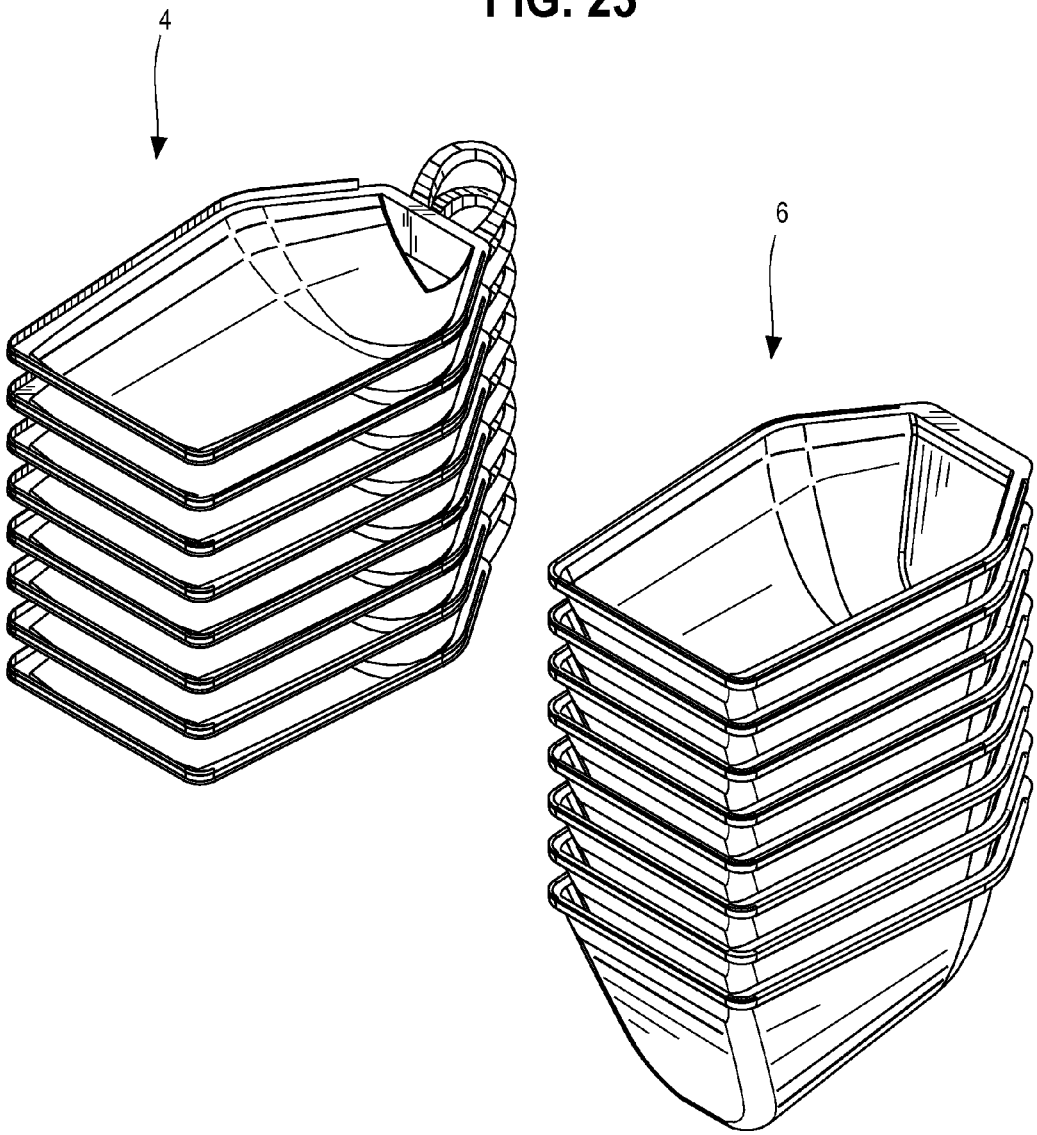
FIG. 23 is a perspective of the container of FIG. 21 showing eight nested lids and eight nested bases.

A third exemplary embodiment of the container 2 is shown in FIGS. 21-23. This embodiment is a two-piece version of container 2. The only difference is that the container 2 does not include the hinge portion 8; otherwise, the container is the same, including the attachment structure between the lid and base and the open and reclose structure for the opening panel. It is contemplated that the container 2 shown in FIGS. 15-20 also can be a two-piece container.

The frangible portion 72 of the container 2 acts as a tamper evident feature because a fractured or broken frangible portion 72 is easily recognizable by a user. If fractured, the container 2 has been opened for a first time.

More specifically, FIG. 24 shows in greater detail one embodiment of a frangible portion 72 that has not been previously fractured or broken. Close inspection reveals that the frangible portion 72 includes the tab outer edge 90, a lid latch 92, and a connecting failure portion 94. The outer edge 90 extends above the lower surface 96 of the lid latch 92, while the failure portion 94 forms a "Z" like configuration with the outer edge 90 and the latch 92.

As shown in FIG. 25, after the failure portion 94 of the frangible portion 72 has been fractured, the outer edge 90 and latch 92 are spaced from one another because the failure portion 94 is no longer present. In some circumstances, remnants of the failure portion 94 may be attached to either the outer edge 90 or the latch 92 after the opening panel 16 has been opened, but for all practical purposes, it is no longer present. The tab 84 can then be hinged back so that the contents of the container 2 can be dispensed.

As described above, the outer edge 90 extends above the lower surface 96 of the latch 92. Accordingly, as shown in FIG. 26, rotating the tab 84 back towards and into engagement with the latch 92 deforms either or both of the tab 84 and the latch 92 until the outer edge 90 has extended beyond the latch 92. In this manner, the tab 84 is reclosed and locked.

Figure 27:
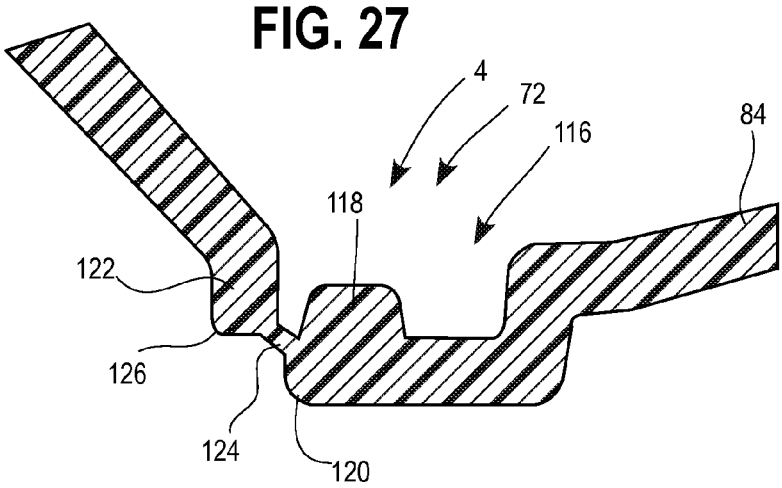
FIG. 27 is a detail view of the lid showing an intact alternative frangible portion.
Figure 28:
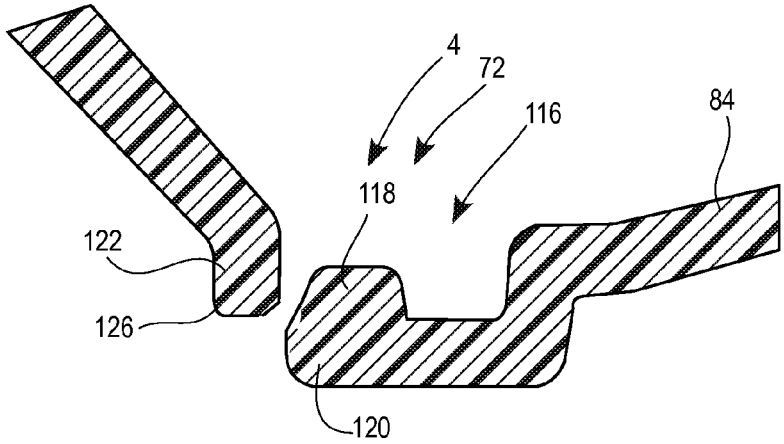
FIG. 28 is a detail view of the lid of FIG. 27 showing a tab defined by the fractured frangible portion.
Figure 29:
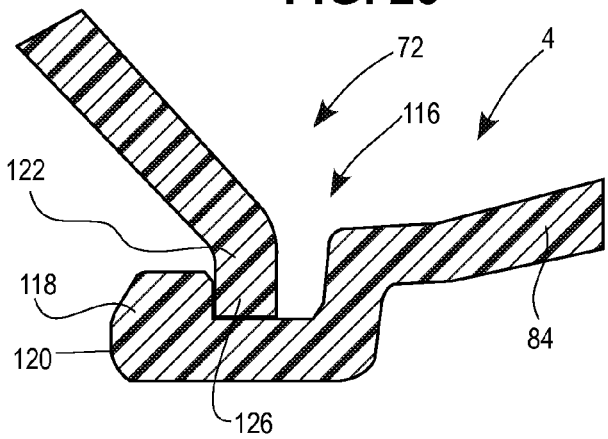
FIG. 29 is detail view of the lid of FIG. 27 showing a lip of the tab positioned within a cavity of the container.

Another embodiment of the frangible portion 72 is shown in FIGS. 27-29. The frangible portion 72 includes a recessed outer tab portion 116 having a tab ridge 118 along the edge 120 of the tab 84, a lid latch portion 122, and a connecting failure portion 124. The tab ridge 118 extends above the lower surface 126 of the lid latch 122, while the failure portion 124 connects the tab edge 120 and the latch 122.

As shown in FIG. 28, after the connecting failure portion 124 of the frangible portion 72 has been fractured, the tab edge 120 and latch 122 are spaced from one another because the failure portion 124 is no longer present. In some circumstances, remnants of the failure portion 124 may be partly attached to either the outer tab edge 120 or the latch 122 after the opening panel 16 has been opened, but for all practical purposes, it is no longer present. The tab 84 can then be hinged back so that the contents of the container 2 can be dispensed.

As described above, the outer tab edge 120 extends above the lower surface 126 of the latch 122. Accordingly, as shown in FIG. 29, rotating the tab 84 back towards and into engagement with the latch 122 deforms either or both of the tab 84 and the latch 122 until the outer tab edge 120 has extended beyond the latch 122. In this manner, the tab 84 is reclosed and locked.

The container can be suitable for a wide range of products, such as dry powder/granular through liquid. The enclosed volume would typically be in the range of 50 cubic centimeters to 200 cubic centimeters but could be smaller or larger depending on the volumetric needs. The container may be rigid or semi rigid. The container 2 can be produced from any suitable material, preferably an environmentally friendly moldable plastic. Further, the container 2 can be produced by any known method, including injection molding and thermoforming.

Further, with the one-piece versions of the container 2, the container can be easily used to package goods. In particular, after a container 2 has been provided and inspected to ensure that the flanges are engageable and the frangible line 72 has not been fractured. Upon a successful inspection, at least one of the lid and base portions 4 and 6 are filled with material. It is preferred that the base portion 6 is filled in that it is typically the larger of the two portions. The unfilled portion of the lid and base portions is shifted about the hinge portion 8 such that the flanges 44 and 50 engage one another. A non-resealable tamper indicating seal 64 is then produced between the upper and lower flanges 44 and 50.

The same applies for the two-piece versions with the exception that the lid is not hinged into engagement with the base. Preferably, the lid is aligned to overlap the base and is placed directly onto the base with one of the above desirable features locking them together.

The use of in-mold labeling to the final package can be utilized in the container forming process. This involves placing a printed polymer label into the injection mold. During injection of the polymer material, the label becomes integral with the molded container. This allows for the container to be labeled while manufacturing of the container and for labeling to be completed on all faces of the package.

While the invention has been particularly described with specific reference to particular methods and product embodiments, it will be appreciated that various alterations, modifications, and adaptations may be based on the present disclosure, and are intended to be within the scope of the invention as defined by the following claims.

What is claimed is:

1. A container comprising:

a first body portion having a first cavity with a first opening defined by a first flange, the first flange defining a plane in which the first opening lies;

a second body portion having a second cavity with a second opening defined by a second flange;

the first body portion having a panel portion at least in part connected thereto with a frangible connection, the frangible connection extending transverse to the plane of the first opening;

a lever extending from the panel portion configured to be manipulated to assert force to open the panel portion to gain access to the inside of the container by severing the frangible connection and forming an opening which lies in a plane transverse to the plane of the first opening; and the first and second flanges being configured to be connected together.

2. The container of claim 1 further comprising a mechanical interconnection between the first and second flanges of the first and second body portions.

3. The container of claim 1 wherein one of the first and second body portions includes an integral guide adjacent the first and second flanges to guide the first and second flanges into engagement.

4. The container of claim 3 further comprising a mechanical interconnection between the first and second flanges of the first and second body portions, where one of the first and second flanges engages a notch defined by the guide.

5. The container of claim 2 wherein the mechanical interconnection is a one way engagement that allows the first and second flanges to be locked into engagement and breaks to unlock and separate the first and second body portions.

6. The container of claim 1 further comprising an adhesive maintaining the first and second flanges together.

7. The container of claim 1 further comprising a weld maintaining the first and second flanges together.

8. The container of claim 1 further comprising a heat seal maintaining the first and second flanges together.

9. The container of claim 2 wherein the mechanical interconnection includes a projection extending from one of the flanges and a cooperating socket defined by the other of the flanges to receive the projection with a locking engagement.

10. The container of claim 1 further comprising a hinge portion attaching the panel portion to the first body portion to enable the panel portion to move between a closed position and an open position.

11. The container of claim 10 wherein the frangible connection provides a reclose feature after the frangible connection has been initially severed to lock the panel portion in the closed position.

12. The container of claim 10 wherein the lever attaches to the panel portion at a location opposite the hinge.

13. The container of claim 12 wherein the lever includes an integral ring portion to engage for operating the lever.

14. The container of claim 13 wherein the ring portion attaches to the lid to secure the panel portion closed.

15. A container comprising:

container bodies;

a flange on each of the container bodies;

a partially frangible portion of one of the container bodies extending from the flange thereof and configured to fracture upon the application of force thereon, the flange being deformable along an intersection with the frangible portion to permit the frangible portion to pivot about the intersection of the frangible portion and the flange of the one container body between an open position and a closed position; and a lever portion for operating the frangible portion, the lever portion having an attachment to the frangible portion and extending away from the attachment toward a central region of the frangible portion so that the lever portion overlaps at least a part of the frangible portion.

16. The container of claim 15 wherein the container bodies are arranged in a closed orientation such that the flange portions thereof are engaged.

17. The container of claim 16 including a sealed connection between the flange portions in the closed orientation to provide a sealed cavity between the container bodies.

18. The container of claim 16 wherein one of the container bodies includes a flat base portion for balancing the container bodies thereon in the closed orientation.

19. The container of claim 15 including a graspable portion of the lever portion for applying force on the frangible portion.

20. The container of claim 19 wherein the graspable portion is positioned away from the flange of the one container body.

21. The container of claim 15 further comprising a hinge connecting the flanges of the container bodies for adjusting the relative orientation of the container bodies about the hinge.

22. The container of claim 15 wherein the frangible portion includes facing interlocking portions that mechanically interact to secure the frangible portion in the closed position after the frangible portion has been fractured.

23. The container of claim 1 further comprising a hinge portion interconnecting the first and second body portions such that the first body portion and the second body portion are capable of being inverted with one on top of the other to engage the first and second flanges.

24. The container of claim 21 wherein the hinge connects to the flange of the one container body opposite the intersection of the flange and the frangible portion of the one container body.

25. The container of claim 1 wherein the frangible connection extends about the panel portion.

26. The container of claim 1 wherein the frangible connection extends from the flange of the first body portion on opposite sides of the panel portion.

27. A container comprising:

container bodies;

a flange on each of the container bodies;

a partially frangible portion of one of the container bodies extending from the flange thereof, the frangible portion including a frangible connection being configured to fracture upon the application of force on the frangible portion, the flange being deformable along an intersection with the frangible portion to permit the frangible portion to pivot about the intersection of the frangible portion and the flange of the one container body between an open position and a closed position;

a lever portion attached to the frangible portion at a location surrounded by the frangible connection and the flange so that the lever portion is configured for operating the frangible portion, wherein the lever portion extends away from the attachment of the lever portion to the frangible portion and toward a central region of the frangible portion so that the lever portion overlaps at least a part of the frangible portion.

28. The container of claim 27 wherein the frangible connection comprises a pair of transversely extending portions and an intersection therebetween and the lever portion is attached to the frangible portion adjacent the intersection between the transversely extending portions of the frangible connection.

29. The container of claim 28 wherein the pair of transversely extending portions of the frangible connection have a generally V-shape.

30. The container of claim 27 wherein the frangible connection extends from the flange of the one container body on opposite sides of the frangible portion.

31. The container of claim 15 further comprising an adhesive connecting the flanges of the container bodies.

32. The container of claim 15 further comprising a weld connecting the flanges of the container bodies.

33. The container of claim 15 further comprising a heat seal connecting the flanges of the container bodies.

* * * * *